US011920441B2

(12) United States Patent
Gee et al.

(10) Patent No.: US 11,920,441 B2
(45) Date of Patent: Mar. 5, 2024

(54) STEERING A WELLBORE USING STRATIGRAPHIC MISFIT HEAT MAPS

(71) Applicant: Magnetic Variation Services, LLC, Denver, CO (US)

(72) Inventors: Timothy William Gee, Englewood, CO (US); Stefan Maus, Boulder, CO (US); Kenneth Robert McCarthy, Lakewood, CO (US); Alexander Michael Mitkus, Denver, CO (US); Jin Sun, Denver, CO (US)

(73) Assignee: Magnetic Variation Services, LLC, Denver, CO (US)

( * ) Notice: Subject to any disclaimer, the term of this patent is extended or adjusted under 35 U.S.C. 154(b) by 615 days.

(21) Appl. No.: 16/821,397

(22) Filed: Mar. 17, 2020

(65) Prior Publication Data

US 2020/0300064 A1 Sep. 24, 2020

Related U.S. Application Data

(60) Provisional application No. 62/985,224, filed on Mar. 4, 2020, provisional application No. 62/932,134, filed (Continued)

(51) Int. Cl.

| | |
|---|---|
| ***E21B 41/00*** | (2006.01) |
| ***E21B 43/30*** | (2006.01) |
| ***E21B 47/07*** | (2012.01) |

(52) U.S. Cl.

CPC ..... *E21B 41/0092* (2013.01); *E21B 43/305* (2013.01); *E21B 47/07* (2020.05)

(58) Field of Classification Search

CPC .... E21B 41/0092; E21B 43/305; E21B 47/07; E21B 2200/20; E21B 7/04; E21B 44/00

See application file for complete search history.

(56) References Cited

U.S. PATENT DOCUMENTS 5,311,951 A * 5/1994 Kyte ..... E21B 47/022 175/40

6,237,404 B1 5/2001 Crary et al.

(Continued)

FOREIGN PATENT DOCUMENTS

CN 102031964 A 4/2011
WO 2016032640 A1 3/2016

(Continued)

OTHER PUBLICATIONS

International Search Report and Written Opinion; PCT/US2020/016434, dated Apr. 29, 2020.

(Continued)

*Primary Examiner* — Kandasamy Thangavelu

(74) *Attorney, Agent, or Firm* — Kilpatrick Townsend & Stockton LLP

(57) ABSTRACT

Systems and methods for using stratigraphic heat maps to steer a well being drilled. Data from one or more offset wells can be provided to a computer system and used with data from a well being drilled to generate one or more stratigraphic heat maps during the drilling of the subject well. The stratigraphic heat maps can be displayed and used to determine the location of the wellbore relative to one or more geological formations, including one or more target formations or within a target formation. Based on the use of the heat maps and the location of the wellbore relative to a target, the drill plan can be adjusted or updated and/or one or more drilling parameters or operations may be adjusted to drill the wellbore, such as to drill the wellbore to the target or to maximize the length of the wellbore within a target zone.

24 Claims, 15 Drawing Sheets

Related U.S. Application Data on Nov. 7, 2019, provisional application No. 62/844,488, filed on May 7, 2019, provisional application No. 62/834,154, filed on Apr. 15, 2019, provisional application No. 62/820,191, filed on Mar. 18, 2019.

(56) References Cited

U.S. PATENT DOCUMENTS 6,408,953 B1 6/2002 Goldman et al.
6,424,919 B1 7/2002 Moran et al.
6,438,495 B1 8/2002 Chau et al.
6,817,425 B2 11/2004 Schultz et al.
6,868,921 B2 3/2005 Burrows et al.
6,968,909 B2 11/2005 Aldred et al.
7,003,439 B2 2/2006 Aldred et al.
7,032,689 B2 4/2006 Goldman et al.
7,073,582 B2 7/2006 Connell et al.
7,128,167 B2 10/2006 Dunlop et al.
7,142,986 B2 11/2006 Moran
7,165,632 B2 1/2007 Burrows et al.
7,191,850 B2 3/2007 Williams
7,302,346 B2 11/2007 Change et al.
7,357,196 B2 4/2008 Goldman et al.
7,359,844 B2 4/2008 Sung et al.
7,460,957 B2 12/2008 Prange et al.
7,546,209 B2 6/2009 Williams
7,555,391 B2 6/2009 Gleitman
7,606,666 B2 10/2009 Repin et al.
7,650,241 B2 1/2010 Jogi et al.
7,684,929 B2 3/2010 Prange et al.
7,814,989 B2 10/2010 Nikolakis-Mouchas et al.
7,861,800 B2 1/2011 Chapman et al.
7,873,476 B2 1/2011 Thorne
7,921,937 B2 4/2011 Brackin et al.
7,946,361 B2 5/2011 Gurjar et al.
7,953,586 B2 5/2011 Chen et al.
7,957,946 B2 6/2011 Pirovolou
7,962,288 B2 6/2011 Gleitman
7,999,695 B2 8/2011 Rodney et al.
8,061,440 B2 11/2011 Chapman et al.
8,061,444 B2 11/2011 Mullins et al.
8,210,257 B2 7/2012 Dusterhoft et al.
8,274,399 B2 9/2012 Strachan et al.
8,278,931 B2 10/2012 Fang et al.
8,376,065 B2 2/2013 Teodorescu et al.
8,407,006 B2 3/2013 Gleitman
8,442,769 B2 5/2013 Phillips et al.
8,463,549 B1 6/2013 Selman et al.
8,463,550 B1 6/2013 Selman et al.
8,489,375 B2 7/2013 Omeragic et al.
8,577,660 B2 11/2013 Wendt et al.
8,612,194 B2 12/2013 Horne et al.
8,614,713 B1 12/2013 Selman et al.
8,615,363 B2 12/2013 Aamodt et al.
8,676,558 B2 3/2014 Pirovolou
8,752,648 B2 6/2014 Goebel et al.
8,768,627 B2 7/2014 Paulk
8,775,145 B2 7/2014 Downton
8,818,779 B2 8/2014 Sadlier et al.
8,875,806 B2 11/2014 Williams
8,939,233 B2 1/2015 Edbury et al.
8,960,326 B2 2/2015 Williams
8,965,703 B2 2/2015 Prakash et al.
8,990,021 B2 3/2015 Jeffryes
9,022,140 B2 5/2015 Marx et al.
9,041,547 B2 5/2015 Hartmann
9,085,958 B2 7/2015 Laing et al.
9,091,139 B2 7/2015 Weng et al.
9,091,140 B1 7/2015 Selman et al.
9,103,192 B2 8/2015 Yang
9,103,936 B2 8/2015 Calleja et al.
9,129,236 B2 9/2015 Elinas et al.
9,181,791 B2 11/2015 Dolgin et al.
9,181,792 B2 11/2015 Pena
9,182,517 B1 11/2015 Selman et al.
9,223,041 B2 12/2015 Wendt et al.
9,238,960 B2 1/2016 Benson et al.
9,322,261 B2 4/2016 Selman et al.
9,388,680 B2 7/2016 Moran
9,424,667 B2 8/2016 Pena et al.
9,441,430 B2 9/2016 Selman et al.
9,534,446 B2 1/2017 Williams
9,556,728 B2 1/2017 de Reynal, Jr.
9,581,018 B2 2/2017 Dolginn et al.
9,702,240 B2 7/2017 Bittar et al.
2007/0061081 A1 3/2007 Moran
2008/0314641 A1 12/2008 McClard
2009/0157367 A1 6/2009 Meyer et al.
2009/0260881 A1 10/2009 Williams
2010/0076740 A1 3/2010 Kuckuk et al.
2010/0185395 A1 7/2010 Pirovolou et al.
2010/0282508 A1 11/2010 Johnston et al.
2011/0031019 A1 2/2011 Williams
2011/0161133 A1 6/2011 Staveley et al.
2011/0191029 A1 8/2011 Jalaki et al.
2011/0232967 A1 9/2011 Williams
2012/0111631 A1 5/2012 Williams
2012/0191354 A1* 7/2012 Caycedo ..... E21B 47/022 702/9
2012/0292111 A1 11/2012 Williams
2013/0166263 A1 6/2013 Shen et al.
2013/0238306 A1 9/2013 Lagenwalter et al.
2014/0000964 A1 1/2014 Selman et al.
2014/0379265 A1 12/2014 Beda et al.
2015/0120196 A1 4/2015 Li et al.
2015/0134255 A1* 5/2015 Zhang ..... G01V 5/04 702/14
2015/0134257 A1 5/2015 Erge et al.
2015/0193705 A1 7/2015 Benson et al.
2015/0211352 A1 7/2015 Sugiura
2015/0218914 A1 8/2015 Marx et al.
2015/0227841 A1 8/2015 Laing et al.
2015/0330209 A1 11/2015 Panchal et al.
2015/0369031 A1 12/2015 Yang et al.
2016/0003008 A1 1/2016 Uribe et al.
2016/0047220 A1 2/2016 Sharp et al.
2016/0076357 A1 3/2016 Hbaieb
2016/0117424 A1 4/2016 Hohl et al.
2016/0186496 A1 6/2016 De Bakker et al.
2016/0265334 A1 9/2016 Dykstra et al.
2016/0281489 A1 9/2016 Dykstra et al.
2016/0290117 A1 10/2016 Dykstra et al.
2016/0327678 A1 11/2016 Benson et al.
2016/0333673 A1 11/2016 Anno et al.
2016/0370480 A1 12/2016 Shetty et al.
2017/0058658 A1 3/2017 Spencer et al.
2017/0145804 A1 5/2017 Wessling et al.
2017/0152739 A1 6/2017 Benson et al.
2017/0183952 A1 6/2017 Williams
2017/0314385 A1 11/2017 Hori et al.
2017/0322332 A1 11/2017 Cooper et al.
2018/0068037 A1 3/2018 Williams
2018/0073351 A9 3/2018 Benson et al.
2018/0225778 A1 8/2018 Grant et al.

FOREIGN PATENT DOCUMENTS

WO 2016044464 A1 * 3/2016 ..... E21B 7/06
WO 2017116417 A1 * 7/2017 ..... G06F 30/20
WO 201714508 A1 8/2017
WO 2018118020 A1 6/2018
WO WO 2019051435 A1 * 3/2019 ..... E21B 44/00

OTHER PUBLICATIONS

Hugh Winkler , "Geosteering-by-Exact-Reference-Bayesian-Network," Geophysics.
Devon Energy Corporation, et al., "Cybersteering: Automated Geosteering By Way of Distributed Computing and Graph Databases in the Cloud," Unconventional Resources Technology Conference, Denver CO, Jul. 2019.
International Search Report and Written Opinion, PCTUS20/23150, dated Jun. 17, 2020.

(56) References Cited

OTHER PUBLICATIONS

Maus, et al., "Automated Geosteering with Fault Detection and Multi-Solution Tracking", IADC/SPE International Drilling Conference and Exhibition, Feb. 25, 2020, pp. 1-12.
PCT/US2020/023150, "International Preliminary Reporton Patentability", dated Sep. 30, 2021, 11 pages.
EP20773624.0, "Extended European Search Report", dated Oct. 14, 2022, 8 pages.
U.S. Appl. No. 16/869,385, "Non-Final Office Action", dated Jun. 2, 2023, 22 pages.

* cited by examiner

1402

1502

1702

1708
1710
DEVIATION (MAPPED TVD- SUBJECT TVD)
-460
-450
-440
-430
FULLY-AUTOMATED
INTERPRETATION
7.5k
8k
8.5k
9k
9.5k
10k
1706
1704
MEASURED DEPTH
1116
0.8
0.6
0.4
0.2
0
NORMALIZED
MISFIT
1206

1802

STRATIGRAPHIC
ANOMALY ZONE
1804
1810
1812
DEVIATION (MAPPED TVD- SUBJECT TVD)
-70
-60
-50
-40
-30
-20
FULLY-AUTOMATED
INTERPRETATION
15.5k
16k
16.5k
17k
1704
1706
1116
MEASURED DEPTH
1806
SEMI-AUTOMATED
INTERPRETATION
1808
WAY
POINTS
0.8
0.6
0.4
0.2
0
NORMALIZED
MISFIT
1206

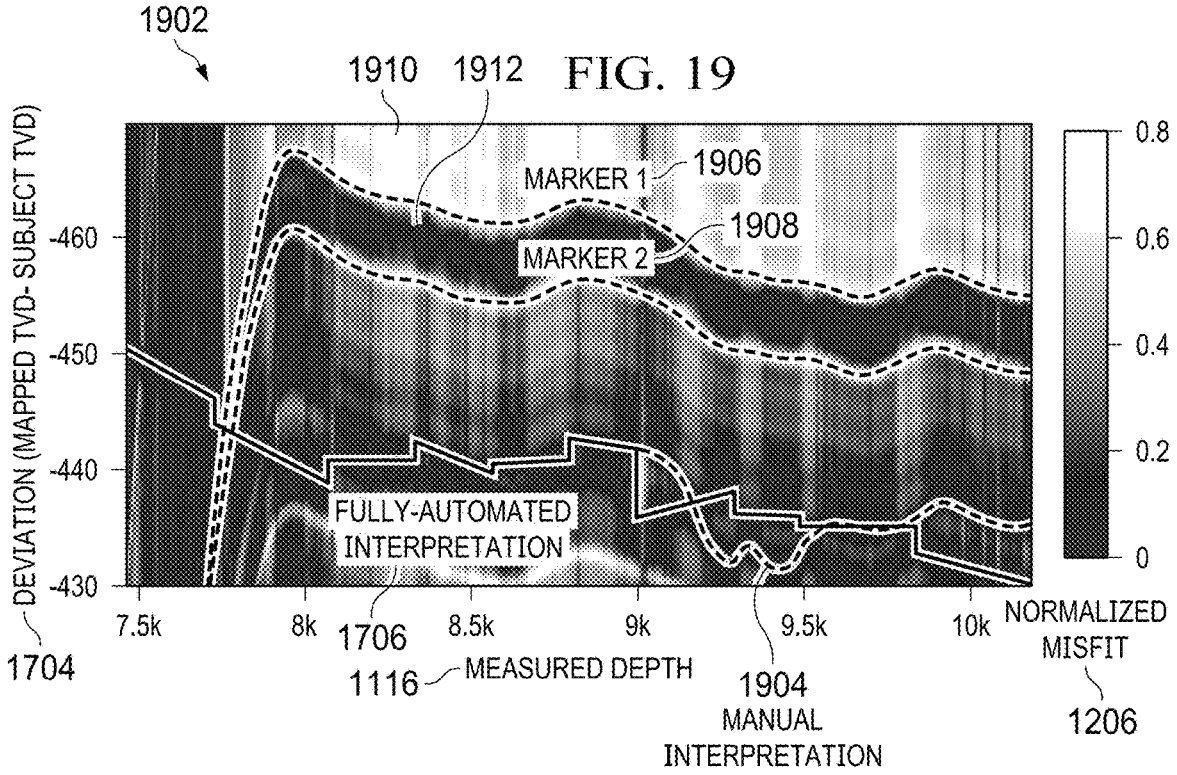
FIG. 19
FIG. 20
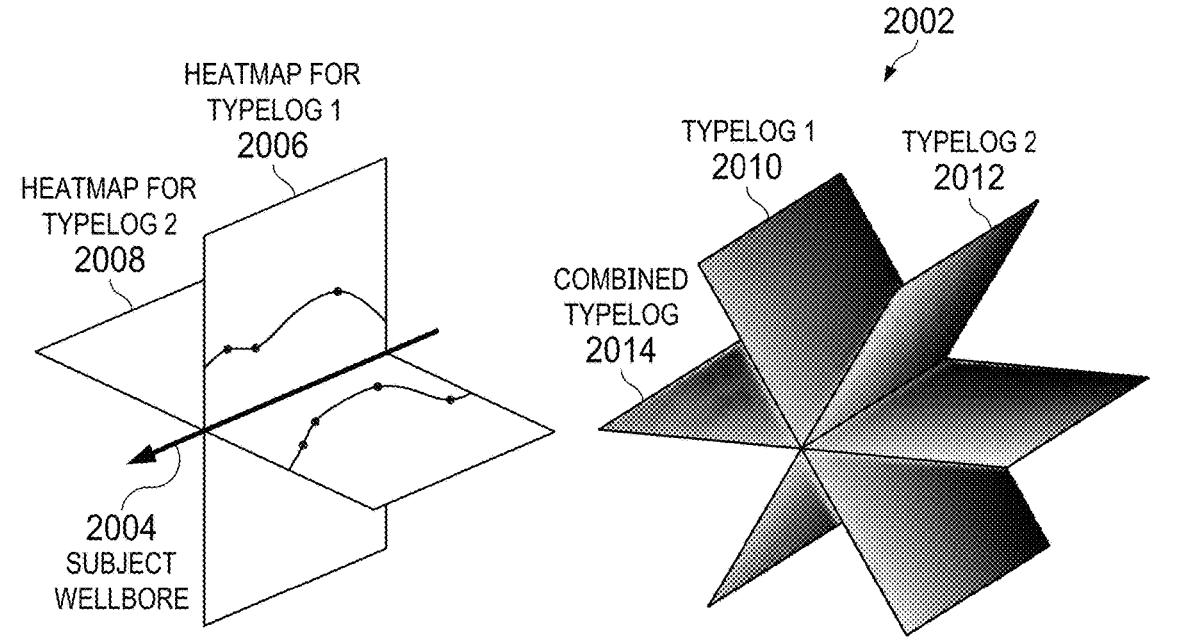

STEERING A WELLBORE USING STRATIGRAPHIC MISFIT HEAT MAPS

CROSS-REFERENCE TO RELATED APPLICATIONS

This application claims the benefit of priority of U.S. Patent Application No. 62/820,191, filed Mar. 18, 2019, and entitled "Optimal Steering of a Wellbore Using Stratigraphic Misfit Heatmaps," U.S. Patent Application No. 62/834,154, filed on Apr. 15, 2019, and entitled "Integrating Reference Data for Steering of a Wellbore Using Stratigraphic Misfit Heat Maps," U.S. Patent Application No. 62/985,224, filed on Mar. 4, 2020, and entitled "Optimal Steering of a Wellbore Using Stratigraphic Misfit Heatmaps," and U.S. Patent Application No. 62/844,488, filed on May 7, 2019, and entitled "Determining the Likelihood and Uncertainty of the Wellbore Being at a Particular Stratigraphic Vertical Depth," and U.S. patent application Ser. No. 62/932,134, filed on Nov. 7, 2019, and entitled "Automated Geosteering with Fault Detection and Multi-Solution Tracking," each of which is hereby incorporated by reference herein.

BACKGROUND

Field of the Disclosure

The present disclosure provides systems and methods useful for optimally steering a wellbore into one or multiple geological target formations when one or multiple wells have already been drilled in the vicinity. The method can be executed with a programmed computer system in fully automated, semi-automated and manual modes.

Description of the Related Art

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Conventional technologies and methods may not adequately address the complicated nature of drilling, and may not be capable of gathering and processing various information from downhole sensors and surface control systems in a timely manner, in order to improve drilling operations and minimize drilling errors.

The determination of the well trajectory from a downhole survey may involve various calculations that depend upon reference values and measured values. However, various internal and external factors may adversely affect the downhole survey and, in turn, the determination of the well trajectory.

A subject wellbore can be steered into one or multiple geological stratigraphic targets. The directional drilling process usually follows a spatial well plan, in which the position of the desired wellbore trajectory can be given in spatial coordinates. However, the desired geological target may not be exactly at the depth assumed when creating the well plan, due to unknown lateral variations and other uncertainties in geological stratigraphy. Therefore, the well plan may be updated based on new stratigraphic information from the wellbore, as it is being drilled. This stratigraphic information can be gained on one hand from Measurement While Drilling, MWD and Logging While Drilling, LWD sensor data, but could also include drilling dynamics data with information, for example, on the hardness of the rock.

SUMMARY

The systems and methods discussed herein may be used to help steer the drilling of a wellbore to a target. In one embodiment various parameters may be combined into a single characteristic function, both for the subject well and one or more offset wells. For every pair of subject well and offset well, a heat map can be computed to display the misfit between the characteristic functions of the subject and offset wells. The heat maps then enable the identification of paths ($x(MD_{SW})$, $y(MD_{SW})$), parameterized by the measured depth, $MD_{SW}$ along the subject well. These paths uniquely describe the vertical depth of the subject well relative to the geology (e.g., formation) at every offset well. Alternatively, the characteristic functions of the offset wells can be combined into a single characteristic function at the location of the subject wellbore. This combined characteristic function changes along the subject well with changes in the stratigraphy. The heat map may also be used to identify stratigraphic anomalies, such as structural faults, stringers and breccia. The identified paths may be used in updating the well plan with the latest data to steer the wellbore into the geological target(s) and keep the wellbore in the target zone.

In one embodiment, a method of geosteering a well is provided, with the method comprising taking measurements at a plurality measured depths, $MD_{SW}$, along a borehole of a subject well being drilled; selecting an offset well log with measurements at a plurality of stratigraphic vertical depths $SVD_{OW}$; computing a misfit value, MV for each of a plurality of pairs of measurements of the subject well measured depth, $MD_{SW}$ and the offset well stratigraphic vertical depth, $SVD_{OW}$; determining, responsive to the misfit value, a stratigraphic vertical depth of the borehole of the subject well, $SVD_{SW}$; and drilling the borehole of the subject well responsive to the determined stratigraphic depth to a target stratigraphic depth. The misfit value may be computed using a plurality of offset well logs and may further comprise taking a plurality of measurements at a plurality of measured depths, $MD_{SW}$ along the borehole of the subject well; selecting a plurality of offset well logs, each having a plurality of measurements at true vertical depths, $TVD_{OW}$; generating a mapping of true vertical depths, $TVD_{OW}$ against stratigraphic vertical depth, $SVD_{OW}$, wherein the mapping relates a stratigraphic vertical depth $SVD_{OW}$ to the corresponding true vertical depths, $TVD_{OW}$ of all of the plurality of offset well logs; computing a combined Misfit value, $MV_C$ for each of the measurements at measured depths, $MD_{SW}$ of the borehole of the subject well, and offset measurements of true vertical depths, $TVD_{OW}$ of all of the plurality of offset well logs; determining, responsive to the combined misfit value, $MV_C$, the stratigraphic vertical depth of the borehole of the subject well, $SVD_{SW}$, wherein the stratigraphic vertical depth, $SVD_{SW}$ corresponds to a minimum cost related to the combined misfit value, $MV_C$; and updating a drill plan for the well and/or drilling the borehole of the subject well responsive to the determined stratigraphic vertical depth, $SVD_{SW}$, to the target stratigraphic vertical depth, $TSVD_{SW}$. The plurality of measurements from the multiple offset well logs may be combined into one reference log, and the methods may further comprise taking a plurality of measurements at measured depths, $MD_{SW}$ along the borehole of the subject well; selecting a plurality of offset well logs with measurements at true vertical depths, $TVD_{OW}$ generating a mapping of true vertical depths, $TVD_{OW}$ against stratigraphic vertical depth, $SVD_{OW}$, which relates a stratigraphic vertical depth, $SVD_{OW}$, to the corresponding true vertical depths, $TVD_{OW}$ of all offset well logs; combining the measurements of the offset well logs into a common reference well log organized by stratigraphic vertical depth, $SVD_{OW}$; computing the Misfit value, MV for each of a plurality of pairs of measurements at subject well MD measured depth, $MD_{SW}$ and reference well log organized by stratigraphic vertical depth, $SVD_{OW}$; determining, responsive to the misfit value, the stratigraphic vertical depth of the subject well, $SVD_{SW}$, by minimizing a cost related to the misfit value, MV; and using the inferred stratigraphic depth, $SVD_{SW}$, to steer the subject well to a desired stratigraphic depth range. The measurements on the subject well log and offset well log(s) may include any one or more of gamma ray intensity, azimuthal gamma, resistivity, azimuthal resistivity, density, porosity, rate of progress, mechanical specific energy, rock compressive strength, rate of penetration, differential pressure, and weight on bit. In addition, a stochastic model may be used to characterize the misfit value. The misfit value, MV may be displayed as a heat map, and may be displayed using a combination of measured depth, $MD_{SW}$, stratigraphic vertical depth, $SVD_{OW}$, Relative Stratigraphic Vertical Depth, RSVD, true vertical depth, $TVD_{OW}$ of the offset well, and Vertical Section on the X and Y axis. Moreover, the heat map display may include ancillary data, such as the well plan, the surveyed wellbore position, geological markers, seismic velocities, and/or other geophysical data. Multiple misfit heat maps for multiple measurement types or multiple offset well logs also may be displayed simultaneously, and may be displayed in 3D. In some embodiments, a cost function minimization of the cost function may be used and may be guided by the operator by specifying stratigraphic control points corresponding to the stratigraphic vertical depth, $SVD_{SW}$. In some implementations, an operator may manually interpret one or more paths of minimal misfit in the heat map to specify the stratigraphic vertical depth, $SVD_{SW}$ of the subject wellbore, while in other implementations, some or all of the steps are automatically performed by a computer system, and the computer system may be coupled to one or more control systems of a drilling rig and may automatically send one or more control signals to such rig control systems to adjust one or more drilling parameters or operations, such as to automatically adjust drilling to drill to the target geological zone.

In some embodiments, the present disclosure includes a computer system, with the computer system comprising a processor; a memory coupled to the processor, the memory containing instructions executable by the processor for performing some or all of the following steps: taking measurements at a plurality measured depths, $MD_{SW}$, along a borehole of a subject well being drilled; selecting an offset well log with measurements at a plurality of stratigraphic vertical depths, $SVD_{OW}$; computing a misfit value, MV for each of a plurality of pairs of measurements of the subject well at measured depths, $MD_{SW}$ and the offset well at stratigraphic vertical depths, $SVD_{OW}$ as a function of these two parameters as follows: misfit value, $MV=f(MD_{SW}, SVD_{OW})$; determining, responsive to the computed misfit value, a stratigraphic vertical depth, $SVD_{SW}$ of the borehole of the subject well; and sending a signal to one or more control systems of a drilling rig drilling the subject well to drill the borehole of the subject well responsive to the determined stratigraphic depth to a target stratigraphic depth. The misfit value may be computed by the system by using a plurality of offset well logs and the instructions further comprise instructions for: taking a plurality of measurements at a plurality of measured depths, $MD_{SW}$ along the borehole of the subject well; selecting a plurality of offset well logs, each having a plurality of measurements at true vertical depths, $TVD_{OW}$; generating a mapping of true vertical depths, $TVD_{OW}$ against stratigraphic vertical depth, $SVD_{OW}$, wherein the mapping relates a stratigraphic vertical depth $SVD_{OW}$ to the corresponding true vertical depths, $TVD_{OW}$ of all of the plurality of offset well logs; computing a combined Misfit value, $MV_C$ for each of the measurements at measured depths, $MD_{SW}$ of the borehole of the subject well, and offset measurements of true vertical depths, $TVD_{OW}$ of all of the plurality of offset well logs; determining, responsive to the combined misfit value, $MV_C$, the stratigraphic vertical depth, $SVD_{SW}$ of the borehole of the subject well, wherein the stratigraphic vertical depth corresponds to a minimum cost related to the combined misfit value, $MV_C$; and sending one or more control signals to the one or more control systems to drill the borehole of the subject well responsive to the determined stratigraphic vertical depth, $SVD_{SW}$, to the target stratigraphic depth. The computer system may further compromise instructions for: combining the plurality of measurements from the multiple offset well logs into one reference log; taking a plurality of measurements at measured depths, $MD_{SW}$ along the borehole of the subject well; selecting a plurality of offset well logs with measurements at true vertical depths, $TVD_{OW}$; generating a mapping of true vertical depths, $TVD_{OW}$ against stratigraphic vertical depth, $SVD_{OW}$, which relates a stratigraphic vertical depth, $SVD_{OW}$, to the corresponding true vertical depths, $TVD_{OW}$ of all offset well logs; combining the measurements of the offset well logs into a common reference well log organized by stratigraphic vertical depth, $SVD_{OW}$; computing the Misfit value, MV, for each of a plurality of pairs of measurements at subject well measured depths, $MD_{SW}$ and reference well log organized by stratigraphic vertical depth, $SVD_{OW}$; determining, responsive to the computed misfit value, the stratigraphic vertical depth of the subject well, $SVD_{SW}$, by minimizing a cost related to the Misfit value, MV using the determined stratigraphic vertical depth, $SVD_{SW}$, to steer the subject well to a desired stratigraphic depth range; and sending one or more control signals to the one or more control systems of the drilling rig to drill to the desired stratigraphic depth range. The measurements on the subject well log and offset well log include any one or more of gamma ray intensity, azimuthal gamma, resistivity, azimuthal resistivity, density, porosity, rate of progress, mechanical specific energy, rock compressive strength, rate of penetration, differential pressure, and weight on bit. A stochastic model may be used by the computer system to characterize the misfit value. The collection of misfit values, MV may be displayed as a heat map, with the display being located either or both at the drilling site for the subject well or at a remote location from the drilling site. The misfit value, MV may be displayed using a combination of measured depths, $MD_{SW}$ along the borehole of the subject well, stratigraphic vertical depth, $SVD_{OW}$ of the offset well, Relative Stratigraphic Vertical Depth, RSVD, true vertical depths, $TVD_{OW}$ of the offset well, and Vertical Section on the X and Y axis. In addition, at least a portion of the heat map display may include ancillary data, such as some or all of the well plan, the surveyed wellbore position, geological markers, seismic velocities, and/or other geophysical data, are displayed on at least a portion of the display of the heat map. A plurality of misfit heat maps for either or both of a plurality of measurement types or a plurality of offset well logs also may be displayed simultaneously, and/or may be displayed in 3D.

BRIEF DESCRIPTION OF THE DRAWINGS

For a more complete understanding of the present invention and its features and advantages, reference is now made to the following description, taken in conjunction with the accompanying drawings, in which:

FIG. 19 is a 3D plot of a manual interpretation; and

FIG. 20 is a depiction of a user interface for displaying multiple 3D plots.

DESCRIPTION OF PARTICULAR EMBODIMENT(S)

Figure 1:
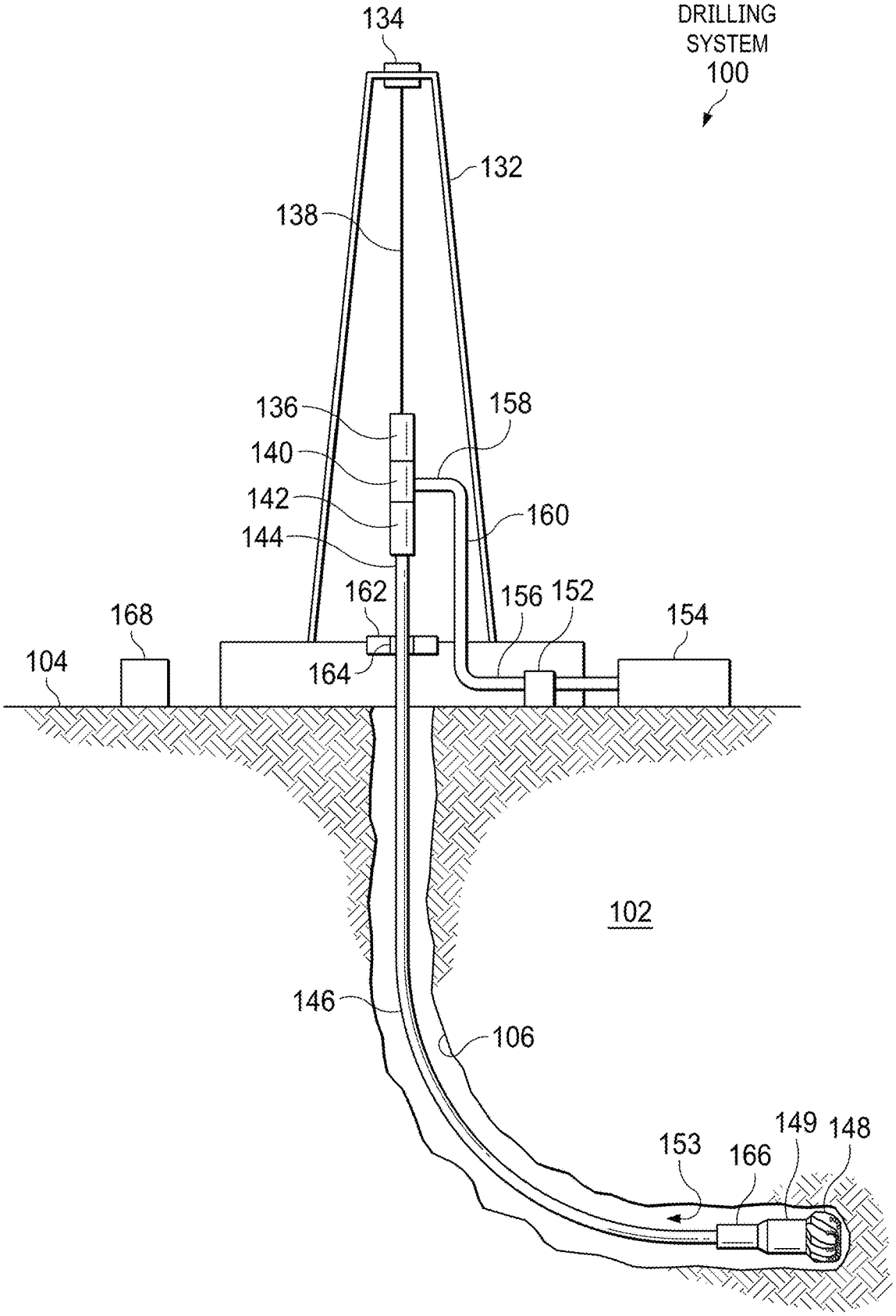
FIG. 1 is a depiction of a drilling system for drilling a borehole.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drilling plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes, because drilling errors can add significant cost to drilling operations. In some cases, drilling errors may permanently lower the output of a well, resulting in substantial long term economic losses due to the lost output of the well.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly, BHA 149 in borehole 106 passing through formation 102. Also visible in drilling system 100 is a rotary table 162 that may be fitted with a master bushing 164 to hold drill string 146 when not rotating.

A mud pump 152 may direct a fluid mixture 153 (e.g., a mud mixture) from a mud pit 154 into drill string 146. Mud pit 154 is shown schematically as a container, but it is noted that various receptacles, tanks, pits, or other containers may be used. Mud 153 may flow from mud pump 152 into a discharge line 156 that is coupled to a rotary hose 158 by a standpipe 160. Rotary hose 158 may then be coupled to top drive 140, which includes a passage for mud 153 to flow into borehole 106 via drill string 146 from where mud 153 may emerge at drill bit 148. Mud 153 may lubricate drill bit 148 during drilling and, due to the pressure supplied by mud pump 152, mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and bottom hole assembly, BHA 149 and is configured to rotate drill string 146 and apply pressure to drill bit 148. Drilling system 100 may include control systems such as a weight-on-bit, WOB/differential pressure control system 522, a positional/rotary control system 524, a fluid circulation control system 526, and a sensor system 528, as further described below with respect to FIG. 5. The control systems may be used to monitor and change drilling rig settings, such as the weight-on-bit, WOB or differential pressure to alter the rate of penetration, ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include Measurement While Drilling, MWD or logging while drilling, LWD (LWD) tools for acquiring information, such as toolface and formation logging information, that may be saved for later retrieval, transmitted with or without a delay using any of various communication means (e.g., wireless, wireline, or mud pulse telemetry), or otherwise transferred to steering control system 168. As used herein, a Measurement While Drilling, MWD tool is enabled to communicate downhole measurements without substantial delay to the surface 104, such as using mud pulse telemetry, while a Logging While Drilling, LWD tool is equipped with an internal memory that stores measurements when downhole and can be used to download a stored log of measurements when the Logging While Drilling, LWD tool is at the surface 104. The internal memory in the Logging While Drilling, LWD tool may be a removable memory, such as a universal serial bus (USB) memory device or another removable memory device. It is noted that certain downhole tools may have both Measurement While Drilling, MWD and Logging While Drilling, LWD capabilities. Such information acquired by sensor system 528 may include information related to hole depth, bit depth, inclination angle, azimuth angle, true vertical depth, gamma count, standpipe pressure, mud flow rate, rotary rotations per minute, RPM, bit speed, rate of penetration, ROP, weight-on-bit, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or bottom hole assembly, BHA 149 or elsewhere along drill string 146 to provide donwhole surveys of borehole 106. Accordingly, downhole tool 166 may be a Measurement While Drilling, MWD tool or a Logging While Drilling, LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10), and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys, and may perform the calculations described herein for surface steering using the downhole surveys and other information referenced herein.

In drilling system 100, to aid in the drilling process, data is collected from borehole 106, such as from sensors in bottom hole assembly, BHA 149, downhole tool 166, or both. The collected data may include the geological characteristics of formation 102 in which borehole 106 was formed, the attributes of drilling system 100, including bottom hole assembly, BHA 149, and drilling information such as weight-on-bit, WOB (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration, ROP through a first rock layer with a first weight-on-bit, WOB, while drilling from 1,200 feet to 1,500 feet occurred at a second rate of penetration, ROP through a second rock layer with a second weight-on-bit, WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with bottom hole assembly, BHA 149 (see also FIG. 10). Alternatively, at least a portion of the collected data may be stored on a removable storage medium, such as using steering control system 168 or bottom hole assembly, BHA 149, that is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with bottom hole assembly, BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface, GUI displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the graphical user interface, GUI.

To implement semi-automatic control, steering control system 168 may itself propose or indicate to the user, such as via the graphical user interface, GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system, RTOS, that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the graphical user interface, GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a well plan, a regional formation history, drilling engineer parameters, downhole tool face/inclination information, downhole tool gamma/resistivity information, economic parameters, reliability parameters, among various other parameters. Some of the input information, such as the regional formation history, may be available from a drilling hub 410, which may have respective access to a regional drilling database, DB 412 (see FIG. 4). Other input information may be accessed or uploaded from other sources to steering control system 168. For example, a web interface may be used to interact directly with steering control system 168 to upload the well plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, the drilling mode, among others. In certain operational modes, such as semi-automatic or automatic, steering control system 168 may generate output information indicative of instructions to rig controls 520 to enable automatic drilling using the latest location of bottom hole assembly, BHA 149. Therefore, an improved accuracy in the determination of the location of bottom hole assembly, BHA 149 may be provided using steering control system 168, along with the methods and operations for surface steering disclosed herein.

Figure 2:
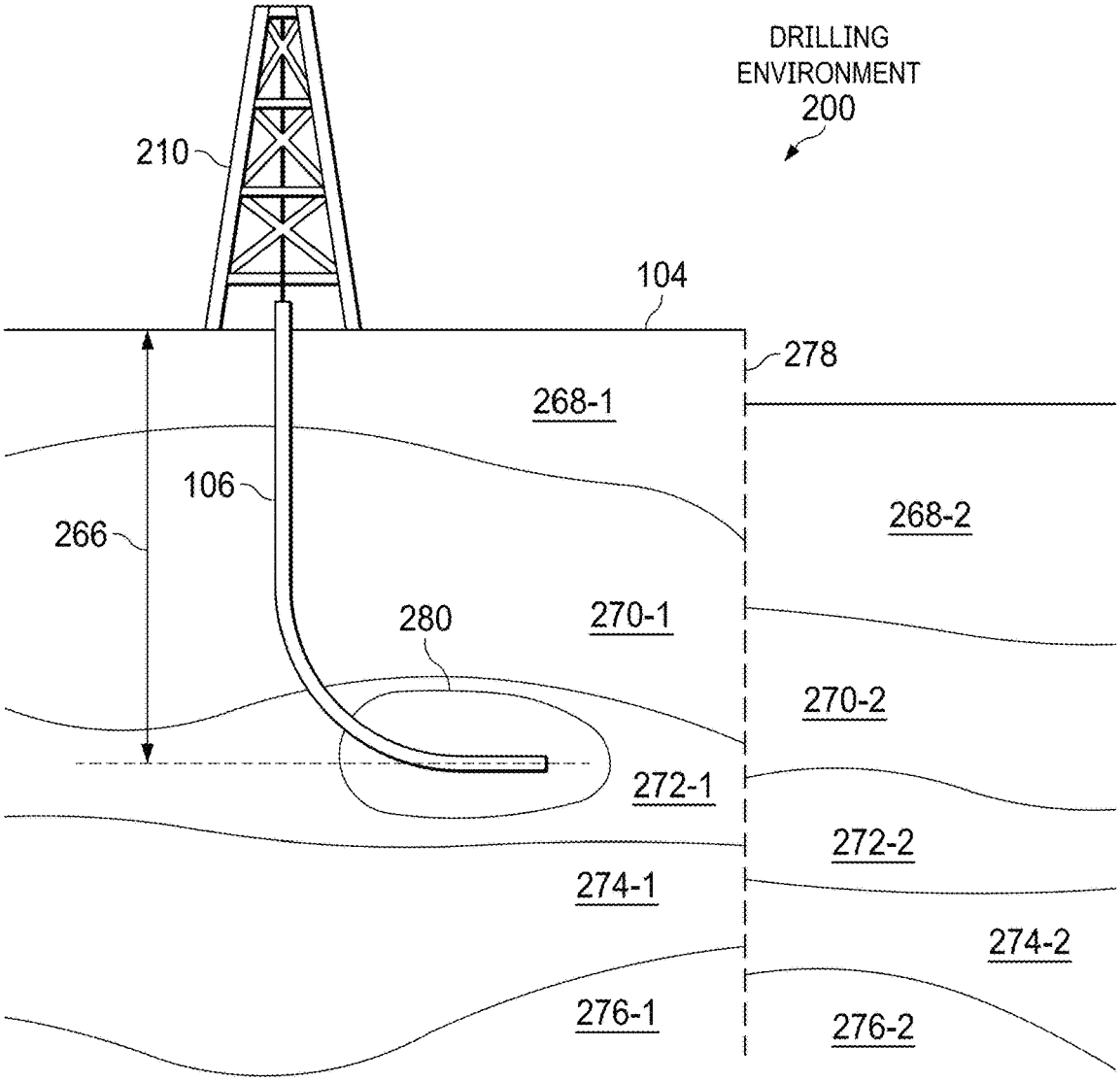
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drilling plan (also referred to as a well plan) has been formulated to drill borehole 106 extending into the ground to a true vertical depth, TVD 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drilling plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size, and may be defined using various different methods and information in different embodiments. In some instances, target area 280 may be specified in the drilling plan using subsurface coordinates, or references to certain markers, that indicate where borehole 106 is to be terminated. In other instances, target area may be specified in the drilling plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106, but may involve staying within a strata layer that varies in depth and thickness as illustrated by strata layer 172. As such, directional drilling may involve multiple vertical adjustments that complicate the trajectory of borehole 106.

Figure 3:
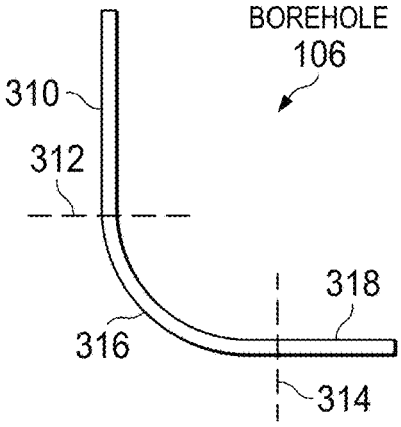
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kick off point 312 in vertical portion 310 and may end at a begin point 314 of horizontal portion 318. The change in inclination in build up section 316 per measured length drilled is referred to herein as a "build rate" and may be defined in degrees per one hundred feet drilled. For example, the build rate may have a value of 6°/100 ft., indicating that there is a six degree change in inclination for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/bottom hole assembly, BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and redrilled along a different path. Such mistakes may be undesirable due to the additional time and expense involved. However, if the built rate is too cautious, additional overall time may be added to the drilling process, because directional drilling generally involves a lower rate of penetration, ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding", are commonly used to form borehole 106. Rotating, also called "rotary drilling", uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at bottom hole assembly, BHA 149. The mud motor may have an adjustable bent housing and is not powered by rotation of the drill string. Instead, the mud motor uses hydraulic power derived from the pressurized drilling mud that circulates along borehole 106 to and from the surface 104 to directionally drill borehole 106 in build up section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, weight-on-bit, WOB, and vibration, among other adjustments. The adjustments may continue until a tool face is confirmed that indicates a direction of the bend of the mud motor is oriented to a direction of a desired deviation (i.e., build rate) of borehole 106. Once the desired orientation of the mud motor is attained, weight-on-bit, WOB to the drill bit is increased, which causes the drill bit to move in the desired direction of deviation. Once sufficient distance and angle have been built up in the curved trajectory, a transition back to rotating mode can be accomplished by rotating the drill string again. The rotation of the drill string after sliding may neutralize the directional deviation caused by the bend in the mud motor due to the continuous rotation around a centerline of borehole 106.

Figure 4:
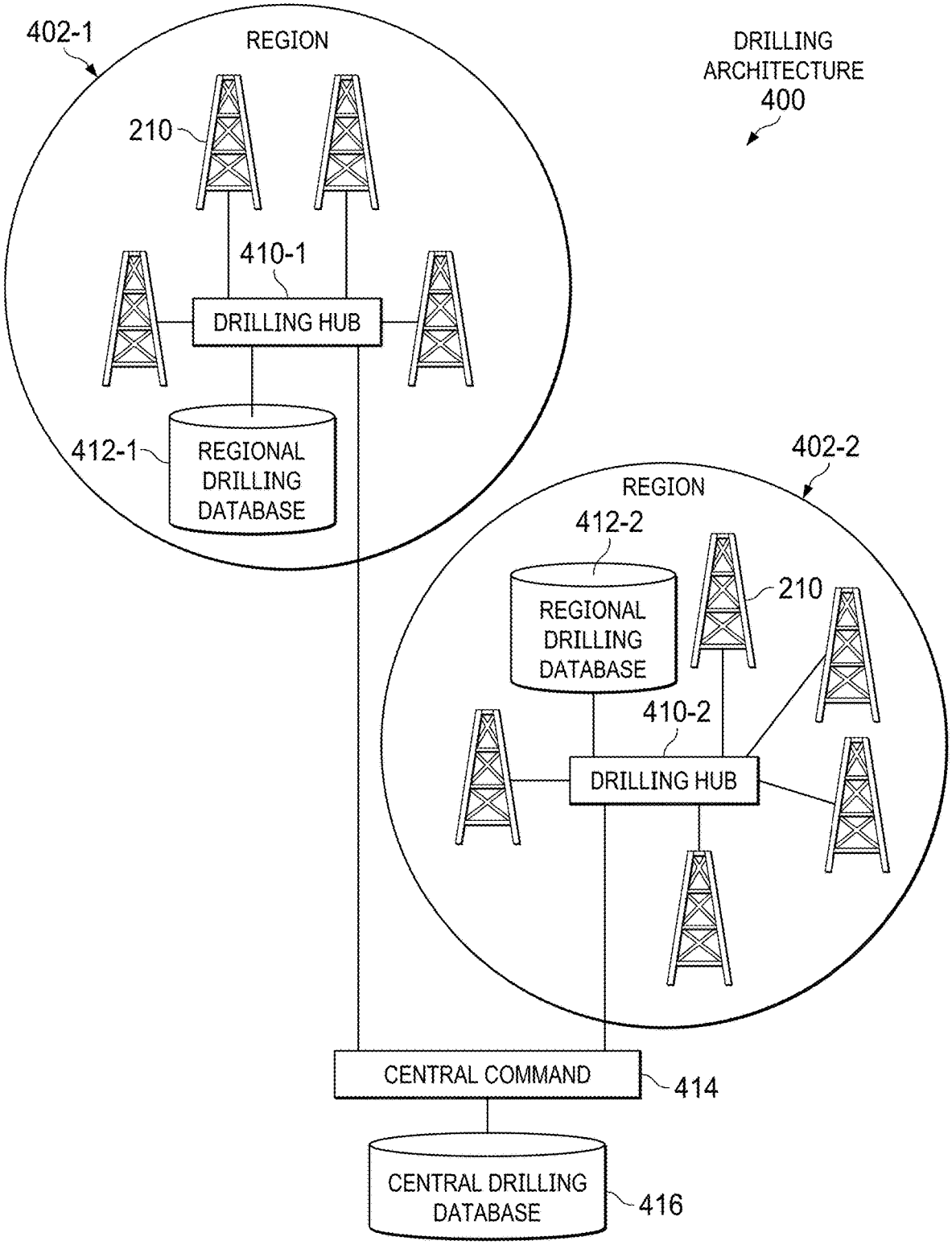
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic illustration of FIG. 4. Additionally, drilling hub 410-1 may have access to a regional drilling database, DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic illustration of FIG. 4. Additionally, drilling hub 410-2 may have access to a regional drilling database, DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402, and may be in different stages of drilling through the depths of formation strata layers at region 402. Thus, for any given well being drilled by drilling rig 210 in a region 402, survey data from the reference wells or offset wells may be used to create the well plan, and may be used for surface steering, as disclosed herein. In some implementations, survey data or reference data from a plurality of reference wells may be used to improve drilling performance, such as by reducing an error in estimating true vertical depth, $TVD_{OW}$ or a position of bottom hole assembly, BHA 149 relative to one or more strata layers, as will be described in further detail herein. Additionally, survey data from recently drilled wells, or wells still currently being drilled, including the same well, may be used for reducing an error in estimating true vertical depth, $TVD_{OW}$ or a position of bottom hole assembly, BHA 149 relative to one or more strata layers.

Also shown in FIG. 4 is central command 414, which has access to central drilling database, DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling database, DB 416 may be a central repository that is accessible to drilling hubs 410 and drilling rigs 210. Accordingly, central drilling database, DB 416 may store information for various drilling rigs 210 in different regions 402. In some embodiments, central drilling database, DB 416 may serve as a backup for at least one regional drilling database, DB 412, or may otherwise redundantly store information that is also stored on at least one regional drilling database, DB 412. In turn, regional drilling database, DB 412 may serve as a backup or redundant storage for at least one drilling rig 210 in region 402. For example, regional drilling database, DB 412 may store information collected by steering control system 168 from drilling rig 210.

In some embodiments, the formulation of a drilling plan for drilling rig 210 may include processing and analyzing the collected data in regional drilling database, DB 412 to create a more effective drilling plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling database, DB 412 and central drilling database, DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
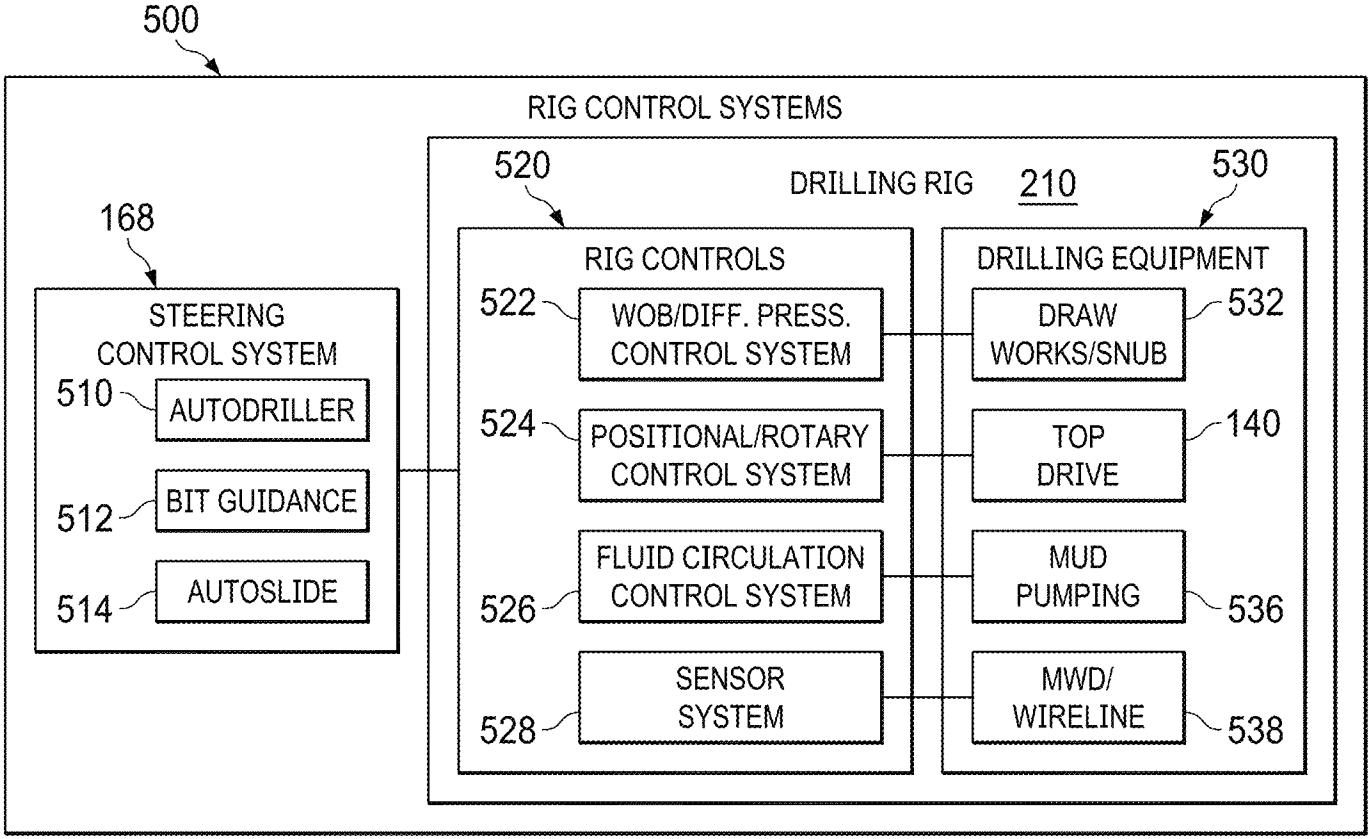
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include weight-on-bit, WOB/differential pressure control system 522, positional/rotary control system 524, fluid circulation control system 526, and sensor system 528, while drilling equipment 530 includes a draw works/snub 532, top drive 140, a mud pumping 536, and a Measurement While Drilling, MWD/wireline 538.

Figure 10:
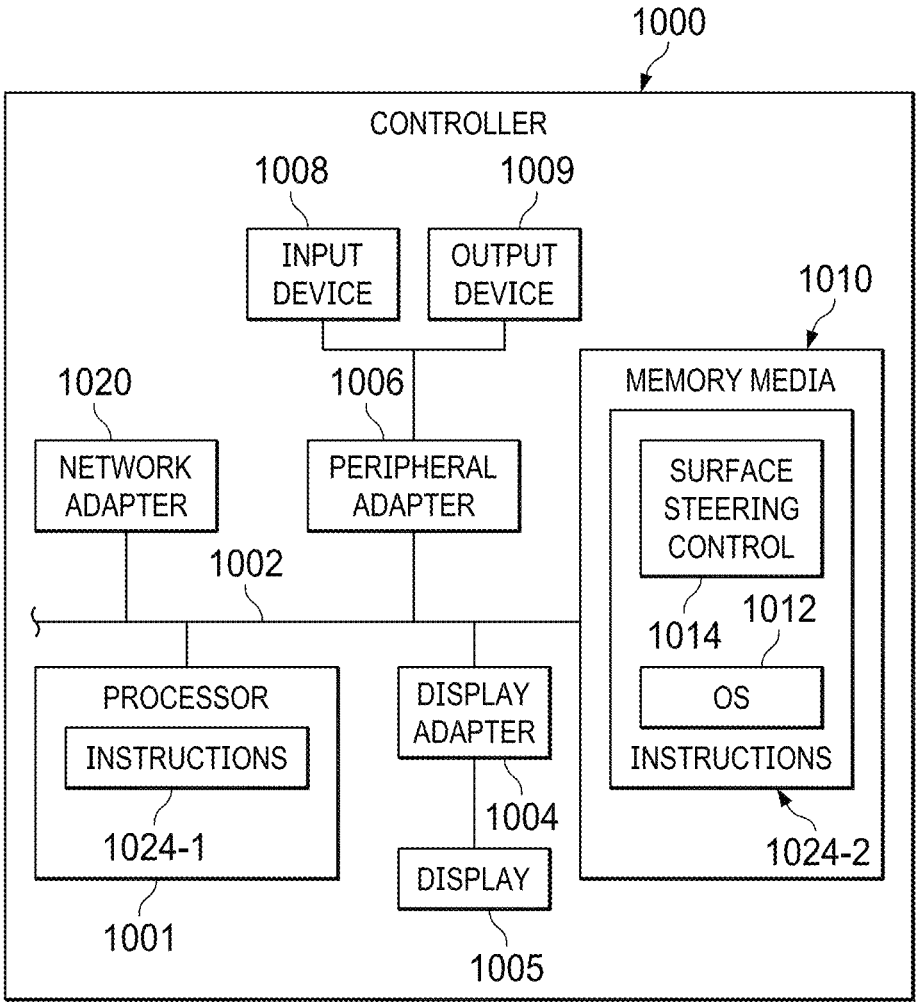
FIG. 10 is a depiction of a controller usable by the rig control systems.

Steering control system 168 represent an instance of a processor having an accessible memory storing instructions executable by the processor, such as an instance of controller 1000 shown in FIG. 10. Also, weight-on-bit, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller, PLC that may not include a user interface but may be used as an embedded controller. Accordingly, it is noted that each of the systems included in rig controls 520 may be a separate controller, such as a programmable logic controller, PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling, and may include certain levels of automation with respect to drilling equipment 530.

In rig control systems 500 of FIG. 5, weight-on-bit, WOB/differential pressure control system 522 may be interfaced with draw works/snubbing unit 532 to control weight-on-bit, WOB of drill string 146. Positional/rotary control system 524 may be interfaced with top drive 140 to control rotation of drill string 146. Fluid circulation control system 526 may be interfaced with mud pumping 536 to control mud flow and may also receive and decode mud telemetry signals. Sensor system 528 may be interfaced with Measurement While Drilling, MWD/wireline 538, which may represent various bottom hole assembly, BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the well plan. Bit guidance 512 may represent an automated control system to monitor and control performance and operation drilling bit 148.

In rig control systems 500, autoslide 514 may represent an automated slide drilling system and may be used for controlling slide drilling. Accordingly, autoslide 514 may enable automate operation of rig controls 520 during a slide, and may return control to steering control system 168 for rotary drilling at an appropriate time, as indicated in the well plan. In particular implementations, autoslide 514 may be enabled to provide a user interface during slide drilling to specifically monitor and control the slide. For example, autoslide 514 may rely on bit guidance 512 for orienting a tool face and on autodriller 510 to set weight-on-bit, WOB or control rotation or vibration of drill string 146.

Figure 6:
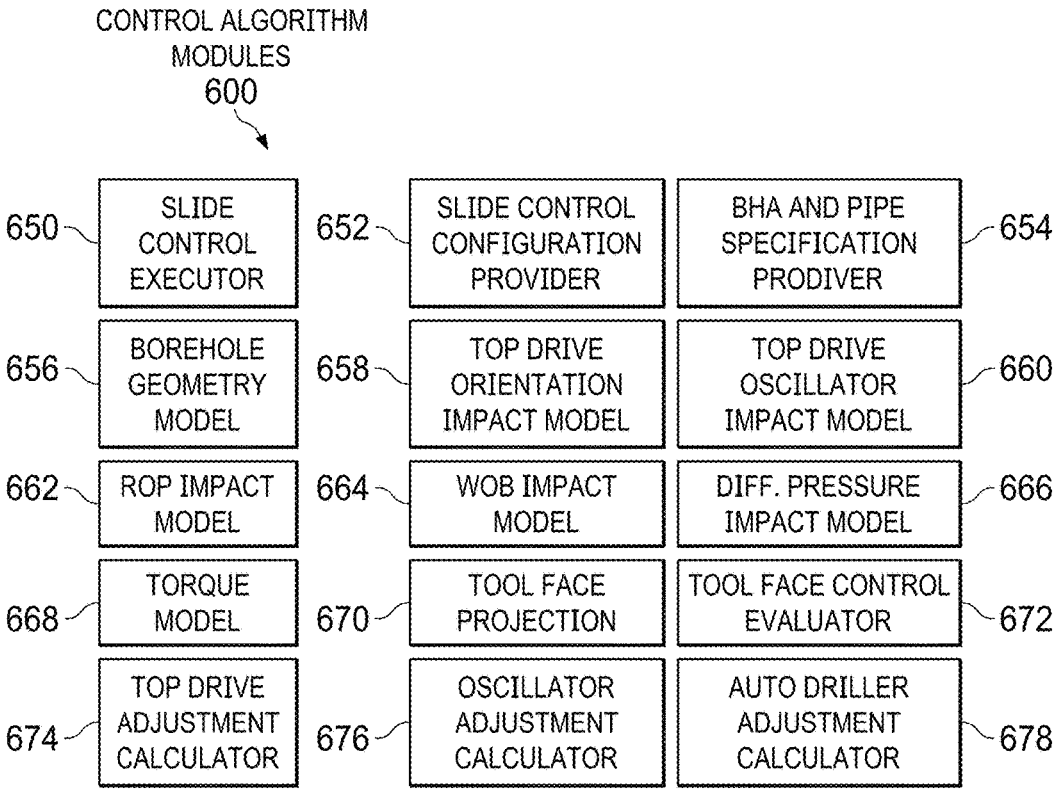
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a bottom hole assembly, BHA & pipe specification provider 654 that is responsible for managing and providing details of bottom hole assembly, BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the tool face control; a top drive oscillator impact model 660 that is responsible for modeling the impact that oscillations of top drive 140 has had on the tool face control; a rate of penetration, ROP impact model 662 that is responsible for modeling the effect on the tool face control of a change in rate of penetration, ROP or a corresponding rate of penetration, ROP set point; a weight-on-bit, WOB impact model 664 that is responsible for modeling the effect on the tool face control of a change in weight-on-bit, WOB or a corresponding weight-on-bit, WOB set point; a differential pressure impact model 666 that is responsible for modeling the effect on the tool face control of a change in differential pressure, DP or a corresponding differential pressure, DP set point; a torque model 668 that is responsible for modeling the comprehensive representation of torque for surface, downhole, break over, and reactive torque, modeling impact of those torque values on tool face control, and determining torque operational thresholds; a tool face control evaluator 672 that is responsible for evaluating all factors impacting tool face control and whether adjustments need to be projected, determining whether re-alignment off-bottom is indicated, and determining off-bottom tool face operational threshold windows; a tool face projection 670 that is responsible for projecting tool face behavior for top drive 140, the top drive oscillator, and auto driller adjustments; a top drive adjustment calculator 674 that is responsible for calculating top drive adjustments resultant to tool face projections; an oscillator adjustment calculator 676 that is responsible for calculating oscillator adjustments resultant to tool face projections; and an autodriller adjustment calculator 678 that is responsible for calculating adjustments to autodriller 510 resultant to tool face projections.

Figure 7:
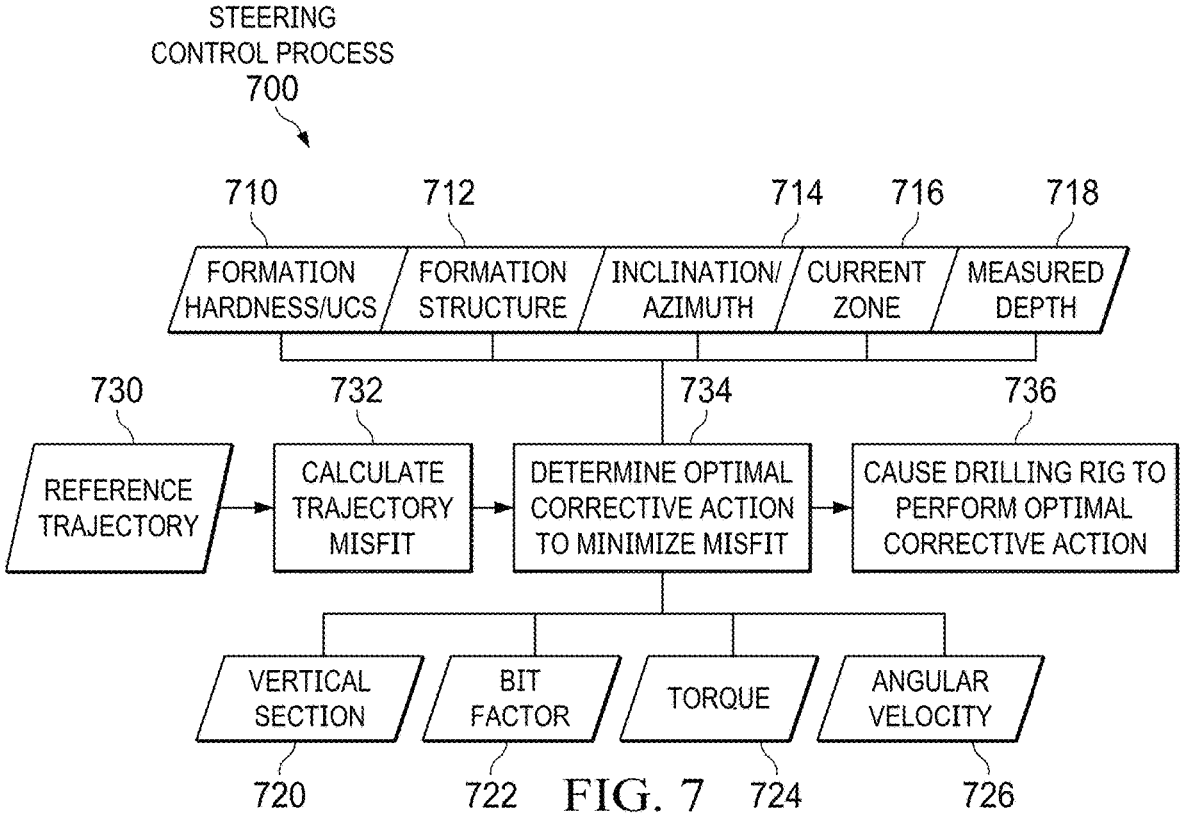
FIG. 7 is a depiction of a steering control process used by the rig control systems.

FIG. 7 illustrates one embodiment of a steering control process 700 for determining an optimal corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired tool face 730, vertical section 720, bit factor 722, mud motor torque 724, reference trajectory 730, vertical section 720, bit factor 722, torque 724 and angular velocity 726. In FIG. 7, reference trajectory 730 of borehole 106 is determined to calculate a trajectory misfit in a step 732. Step 732 may output the trajectory misfit to determine an optimal corrective action to minimize the misfit at step 734, which may be performed using the other inputs described above. Then, at step 736, the drilling rig is caused to perform the optimal corrective action.

It is noted that in some implementations, at least certain portions of steering control process 700 may be automated or performed without user intervention, such as using rig control systems 700 (see FIG. 7). In other implementations, the optimal corrective action in step 736 may be provided or communicated (by display, SMS message, email, or otherwise) to one or more human operators, who may then take appropriate action. The human operators may be members of a rig crew, which may be located at or near drilling rig 210, or may be located remotely from drilling rig 210.

Figure 8:
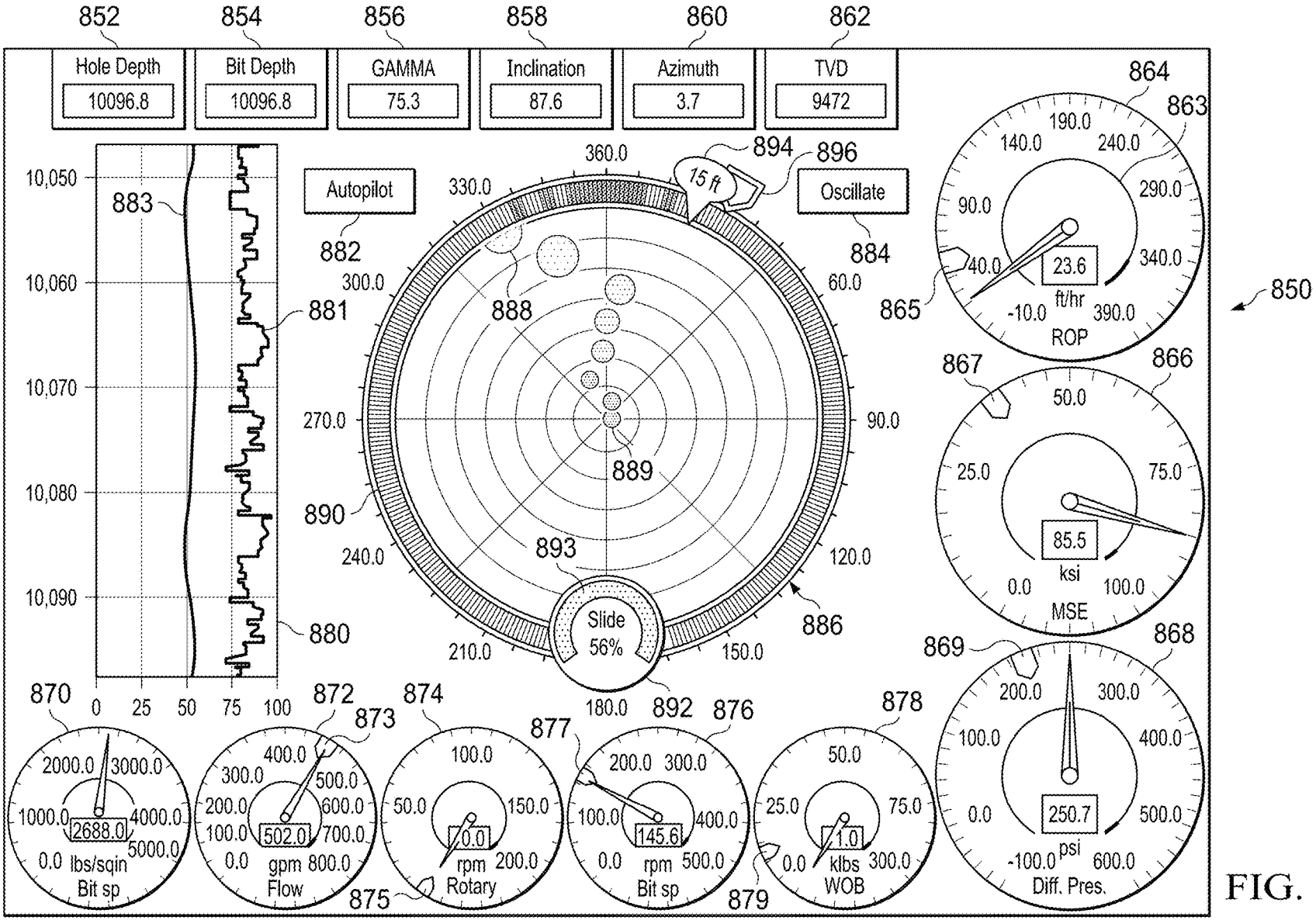
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168.

As shown in FIG. 8, user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a rate of penetration, ROP indicator 864, a mechanical specific energy, MSE indicator 866, a differential pressure indicator 868, a standpipe pressure indicator 870, a flow rate indicator 872, a rotary rotations per minute, RPM (angular velocity) indicator 874, a bit speed indicator 876, and a weight-on-bit, WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, rate of penetration, ROP indicator 864 may include a marker 865 indicating that the target value is 50 feet/hour (or 15 m/h). MSE indicator 866 may include a marker 867 indicating that the target value is 37 ksi (or 255 MPa). Differential pressure indicator 868 may include a marker 869 indicating that the target value is 200 psi (or 1.38 kPa). Rate of penetration, ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gpm (or 31.5 L/s). Rotary rotations per minute, RPM indicator 874 may include a marker 875 indicating that the target value is 0 rotations per minute, RPM (e.g., due to sliding). Bit speed indicator 876 may include a marker 877 indicating that the target value is 150 rotations per minute, RPM. Weight-on-bit, WOB indicator 878 may include a marker 879 indicating that the target value is 10 klbs (or 4,500 kg). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), rate of penetration, ROP 883 (e.g., empirical rate of penetration, ROP and normalized rate of penetration, ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical tool face orientation information (e.g., which way the bend is pointed). For purposes of illustration, circular chart 886 represents three hundred and sixty degrees. A series of circles within circular chart 886 may represent a timeline of tool face orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular tool face orientation with little deviation. As shown in user interface 850, the color blue may extend from approximately 22-337 degrees, the color green may extend from approximately 15-22 degrees and 337-345 degrees, the color yellow may extend a few degrees around the 13 and 345 degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., a rate of penetration, ROP of 100 feet/hour). For example, rate of penetration, ROP indicator 868 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). Rate of penetration, ROP indicator 868 may also display a marker at 100 feet/hour to indicate the desired target rate of penetration, ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
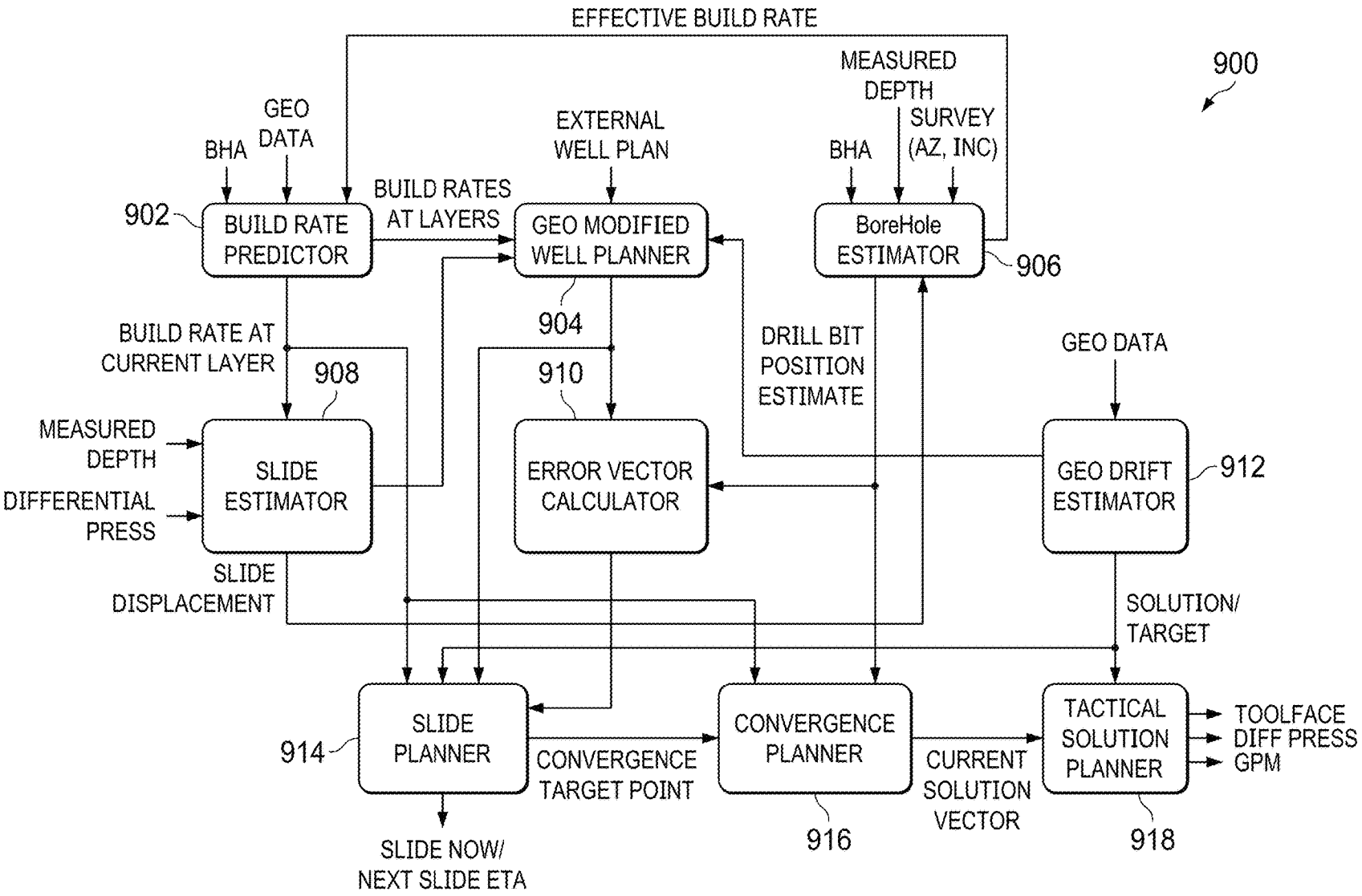
FIG. 9 is a depiction of a guidance control loop performed by the rig control systems.

Referring to FIG. 9, one embodiment of a guidance control loop, GCL 900 is shown in further detail guidance control loop, GCL 900 may represent one example of a control loop or control algorithm executed under the control of steering control system 168. Guidance control loop, GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of guidance control loop, GCL 900, the term "external input" refers to input received from outside guidance control loop, GCL 900, while "internal input" refers to input exchanged between functional modules of guidance control loop, GCL 900.

In FIG. 9, build rate predictor 902 receives external input representing bottom hole assembly, BHA information and geological information, receives internal input from the borehole estimator 906, and provides output to geo modified well planner 904, slide estimator 908, slide planner 914, and convergence planner 916. Build rate predictor 902 is configured to use the bottom hole assembly, BHA information and geological information to predict drilling build rates of current and future sections of borehole 106. For example, build rate predictor 902 may determine how aggressively a curve will be built for a given formation with bottom hole assembly, BHA 149 and other equipment parameters.

In FIG. 9, build rate predictor 902 may use the orientation of bottom hole assembly, BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90 degree angle may provide a good tool face and a clean drill entry, while approaching the rock layer at a 45 degree angle may build a curve relatively quickly. An angle of approach that is near parallel may cause drill bit 148 to skip off the upper surface of the strata layer of rock. Accordingly, build rate predictor 902 may calculate bottom hole assembly, BHA orientation to account for formation transitions. Within a single strata layer, build rate predictor 902 may use the bottom hole assembly, BHA orientation to account for internal layer characteristics (e.g., grain) to determine build rates for different parts of a strata layer. The bottom hole assembly, BHA information may include bit characteristics, mud motor bend setting, stabilization and mud motor bit to bend distance. The geological information may include formation data such as compressive strength, thicknesses, and depths for formations encountered in the specific drilling location. Such information may enable a calculation-based prediction of the build rates and rate of penetration, ROP that may be compared to both results obtained while drilling borehole 106 and regional historical results (e.g., from the regional drilling database, DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a well plan, internal input from build rate predictor 902 and geo drift estimator 912, and provides output to slide planner 914 and error vector calculator 910. Geo modified well planner 904 uses the input to determine whether there is a more optimal trajectory than that provided by the well plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 904 may then treat the target as a vector target, while remaining within the error limits of the original well plan. In some embodiments, geo modified well planner 904 may be an optional module that is not used unless the well plan is to be modified. For example, if the well plan is marked in steering control system 168 as non-modifiable, geo modified well planner 904 may be bypassed altogether or geo modified well planner 904 may be configured to pass the well plan through without any changes.

In FIG. 9, borehole estimator 906 may receive external inputs representing bottom hole assembly, BHA information, measured depth information, survey information (e.g., azimuth and inclination), and may provide outputs to build rate predictor 902, error vector calculator 910, and convergence planner 916. Borehole estimator 906 may be configured to provide an estimate of the actual borehole and drill bit position and trajectory angle without delay, based on either straight line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample tool face orientation, differential pressure, measured depth, $MD_{SW}$, incremental movement, mechanical specific energy, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In guidance control loop, GCL 900, using slide estimator 908, each tool face update may be algorithmically merged with the average differential pressure of the period between the previous and current tool face readings, as well as the measured depth, MD change during this period to predict the direction, angular deviation, and measured depth, MD progress during the period. As an example, the periodic rate may be between 10 and 60 seconds per cycle depending on the tool face update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the well plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of rate of penetration, ROP and bottom hole assembly, BHA 149. Geological drift estimator 912 is configured to provide a drift estimate as a vector that can then be used to calculate drift compensation parameters that can be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost equation and plan for sliding activity, which may include factoring in bottom hole assembly, BHA wear, expected build rates of current and expected formations, and the well plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material, LCM planner may be provided as part of slide planner 914 or elsewhere (e.g., as a stand-alone module or as part of another module described herein). The loss circulation material, LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the loss circulation material, LCM planner may control pumping loss circulation material, LCM into the borehole to clog up the holes in the porous rock surrounding the borehole to establish a more closed-loop control system for the fluid.

In FIG. 9, slide planner 914 may also look at the current position relative to the next connection. A connection may happen every 90 to 100 feet (or some other distance or distance range based on the particulars of the drilling operation) and slide planner 914 may avoid planning a slide when close to a connection or when the slide would carry through the connection. For example, if the slide planner 914 is planning a 50 foot slide but only 20 feet remain until the next connection, slide planner 914 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the tool face before finishing the slide. During slides, slide planner 914 may provide some feedback as to the progress of achieving the desired goal of the current slide. In some embodiments, slide planner 914 may account for reactive torque in the drill string. More specifically, when rotating is occurring, there is a reactional torque wind up in drill string 146. When the rotating is stopped, drill string 146 unwinds, which changes tool face orientation and other parameters. When rotating is started again, drill string 146 starts to wind back up. Slide planner 914 may account for the reactional torque so that tool face references are maintained, rather than stopping rotation and then trying to adjust to an optimal tool face orientation. While not all downhole tools may provide tool face orientation when rotating, using one that does supply such information for guidance control loop, GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and optimal convergence target point along the planned trajectory. The convergence plan may take account the amount of sliding/drilling ahead that has been planned to take place by slide planner 914. Convergence planner 916 may also use bottom hole assembly, BHA orientation information for angle of attack calculations when determining convergence plans as described above with respect to build rate predictor 902. The solution provided by convergence planner 916 defines a new trajectory solution for the current position of drill bit 148. The solution may be immediate without delay, or planned for implementation at a future time that is specified in advance.

In FIG. 9, tactical solution planner 918 receives internal inputs from geological drift estimator 912 and convergence planner 916, and provides external outputs representing information such as tool face orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by guidance control loop, GCL 900 in additional modules or added to an existing module. For example, there is a relationship between the rotational position of the drill pipe on the surface and the orientation of the downhole tool face. Accordingly, guidance control loop, GCL 900 may receive information corresponding to the rotational position of the drill pipe on the surface. Guidance control loop, GCL 900 may use this surface positional information to calculate current and desired tool face orientations. These calculations may then be used to define control parameters for adjusting the top drive 140 to accomplish adjustments to the downhole tool face in order to steer the trajectory of borehole 106.

For purposes of example, an object-oriented software approach may be utilized to provide a class-based structure that may be used with guidance control loop, GCL 900 or other functionality provided by steering control system 168. In guidance control loop, GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a weight-on-bit, WOB/differential pressure model, a positional/rotary model, a mechanical specific energy, MSE model, an active well plan, and control limits. The drilling model class may produce a control output solution and may be executed via a main processing loop that rotates through the various modules of guidance control loop, GCL 900. The drill bit model may represent the current position and state of drill bit 148. The drill bit model may include a three dimensional (3D) position, a drill bit trajectory, bottom hole assembly, BHA information, bit speed, and tool face (e.g., orientation information). The 3D position may be specified in north-south (NS), east-west (EW), and true vertical depth, TVD. The drill bit trajectory may be specified as an inclination angle and an azimuth angle. The bottom hole assembly, BHA information may be a set of dimensions defining the active bottom hole assembly, BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, weight-on-bit, WOB/differential pressure model, positional/rotary model, and mechanical specific energy, MSE model. The mud pump model represents mud pump equipment and includes flow rate, standpipe pressure, and differential pressure. The weight-on-bit, WOB/differential pressure model represents draw works or other weight-on-bit, WOB/differential pressure controls and parameters, including weight-on-bit, WOB. The positional/rotary model represents top drive or other positional/rotary controls and parameters including rotary rotations per minute, RPM and spindle position. The active well plan represents the target borehole path and may include an external well plan and a modified well plan. The control limits represent defined parameters that may be set as maximums and/or minimums. For example, control limits may be set for the rotary rotations per minute, RPM in the top drive model to limit the maximum rotations per minute, RPMs to the defined level. The control output solution may represent the control parameters for drilling rig 210.

Each functional module of guidance control loop, GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, guidance control loop, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing surface steering according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and surface steering control 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing guidance control loop, GCL 900, as mentioned previously, among other methods and operations disclosed herein.

In other embodiments, stratigraphic information may also be used to steer a wellbore into one or multiple geological target formations when one or multiple wells have already been drilled in the vicinity. In particular, stratigraphic misfit heat maps can be computed to determine and/or display the misfit between the characteristic functions of the subject and offset wells.

The methods disclosed herein involving the use of stratigraphic misfit heat maps can be executed in fully automated, semi-automated and/or manual modes. Systems for performing such methods and/or steering a well may be separate computer systems or may be combined with some or all of the computer systems described above. For example, the methods described herein involving the generation and use of stratigraphic misfit heat maps may be implemented automatically, and may form a portion of steering control system 168, rig control system 520, or may be a part of another computer system, or may be a separate and distinct computer system. It is to be noted that in some implementations, at least certain portions of the stratigraphic misfit heat map methods may be performed without user intervention, and in some implementations, an optimal corrective action, interpretation, or analysis may be used to update or modify a well plan automatically, and/or may be provided or communicated (such as by display, SMS message, email, or otherwise) to one or more human operators, who may then take appropriate action. The human operators to whom the information is provided may be members of a rig crew, which may be located at or near drilling rig 210, and/or may be located remotely from drilling rig 210.

The subject wellbore can be steered into one or multiple geological stratigraphic targets. The directional drilling process typically follows a spatial well plan, in which the position of the desired wellbore trajectory is given in spatial coordinates. However, the desired geological target may not be at exactly the depth assumed when creating the well plan, due to unknown lateral variations and other uncertainties in geological stratigraphy. Therefore, it is common practice to update the well plan based on new stratigraphic information from the wellbore, as it is being drilled. This stratigraphic information is gained on one hand from Measurement While Drilling, MWD and Logging While Drilling, LWD sensor data, but could also include drilling dynamics data giving information, for example, on the hardness of the rock, and/or on properties like weight-on-bit, WOB, rate of penetration, ROP, mechanical specific energy, MSE, and the like. To identify the stratigraphic depth of the subject wellbore, the measurements from the subject well can be compared with corresponding measurements from existing well logs and local geologic information in the vicinity.

In the simplest implementation of the disclosed method, the measurements on the subject wellbore at increasing measured depth, $MD_{SW}$ along the wellbore are compared with a single offset well log, organized by Stratigraphic Vertical Depth, $SVD_{OW}$. Taking the statistical properties of the measurements into account, a misfit can be computed for every pair of subject well measured depth, $MD_{SW}$ and offset log stratigraphic vertical depth, $SVD_{OW}$, representing each possible stratigraphic vertical depth, $SVD_{OW}$ that the gamma measurement could correspond to for each measured depth, $MD_{SW}$ along the wellbore. This misfit can be displayed as a stratigraphic misfit heat map, for example with measured depth, $MD_{SW}$ on the X axis, stratigraphic vertical depth, $SVD_{OW}$ on the Y axis and the misfit color coded at the misfit value, MV position on the display. Geologically plausible interpretations are then visible as paths of minimal misfit through the heat map. Any such path stratigraphic vertical depth, $SVD_{SW}$ specifies the stratigraphic depth along the wellbore trajectory, which can be used to steer the wellbore toward a desired stratigraphic target.

Better use of the available information can be made by an extended implementation, in which the measurements of the subject wellbore are simultaneously compared with multiple offset well logs. A pre-drill geomodel can be constructed to provide a mapping between the stratigraphic depths of all the offset well logs. The wellbore position at measured depth, $MD_{SW}$ can then be compared simultaneously with multiple offset well logs at corresponding stratigraphic depths to compute a combined misfit.

The heat map may also be used to identify stratigraphic anomalies, such as structural faults, stringers and breccia. An automated algorithm may be used to identify stratigraphic vertical depth, $SVD_{SW}$ paths of minimal misfit through the heat map. These paths can further be guided through stratigraphic control points set by an operator. The identified paths may directly be used in applying corrections to the well plan to steer the subject wellbore into a geological target or keep it in a stratigraphic target zone.

To make optimal use of the geological information of multiple offset wells in the vicinity of the subject well, it is useful to first create a mapping which relates the stratigraphic depths between the offset wells.

In a simple form, this mapping can specify the depths of corresponding geologic marker horizons on each offset well and then interpolate these marker horizons into a 2D surface between the offset wells. Any stratigraphic depth on any offset wellbore between two marker horizons can then be related to the corresponding depth on another offset well by linear interpolation. For example, if the depth of interest on one offset well is at one third of the depth interval between marker horizons A and B, we can assign the corresponding stratigraphic depth on the other offset well as one third of the depth interval between the known marker horizons A and B.

A more accurate mapping extends the concept of marker horizons by identifying one of the offset wells as the stratigraphic master well, which defines the stratigraphic depth axis for stratigraphic vertical depth, $SVD_{OW}$. For each offset well we can then define a function relating the stratigraphic depth of the master well to the stratigraphic depth of the offset well. Interpolation of stratigraphic depth in the area between the offset wells then takes the form of a 2D interpolation between functions, as a generalization of the 2D interpolation between markers.

The result of either the simple marker horizon approach or the more accurate continuous approach is a 3D geomodel, that relates the stratigraphic vertical depth SVD(x0, y0) at one location (x0, y0) to the corresponding stratigraphic vertical depth SVD(x, y) at any other location (x, y) within the coverage area of the 3D geomodel. This mapping enables the measurements on the subject well to be compared simultaneously with the corresponding measurements on all offset wells.

If the geomodel were perfectly accurate and the spatial position of the subject wellbore position were perfectly known, then the geomodel would inform the driller of the exact stratigraphic depth of any position along the subject wellbore. However, due to inaccuracies in the geomodel and the surveyed location of the subject wellbore, the actual stratigraphic depth of the subject wellbore typically has to be verified and corrected during drilling. To geosteer the well, one can find the corrected stratigraphic depth of the subject well at which the subject measurements optimally agree with the measurements at the corresponding stratigraphic depths on the offset wells.

Finding the most likely stratigraphic depth of the subject wellbore can be done with a statistical model. We can characterize the measurement uncertainties and spatial variation of a specific parameter (such as gamma ray intensity) by an empirical covariance model. The model specifies the lateral covariance and the vertical covariance between sensor measurements for the same, as well as for different well logs.

The lateral covariance across well logs can empirically be estimated by using a large sample of vertical wells in a representative area and fitting a model specifying the covariance as a function of spatial separation. Correspondingly, the lateral covariance along a single well log can empirically be estimated from horizontal wells in a representative area, again fitting a model specifying the covariance as a function of spatial separation. The vertical covariances along a vertical wellbore and across horizontal wellbores can be empirically estimated in the same way.

The empirical covariance model enables assembling a covariance matrix for a specific combination of measurements on subject and offset wells. This matrix specifies the covariances for all relevant pairs of differences between subject and offset well measurements.

The covariance model can be used to specify a misfit value, MV between a measurement on the subject well and the measurements at the corresponding stratigraphic vertical depth on the offset wells, using a statistical norm, such as misfit value, $MV=d^T\ cov^{-1}\ d$, where d is the vector of differences between subject well measurement at measured depth, $MD_{SW}$ and offset well measurements at the depths mapped to stratigraphic vertical depth, $SVD_{OW}$, and $cov^{-1}$ is the inverse of the covariance matrix given by the statistical model.

The stratigraphic heat map displays the misfit between the measurements of the subject wellbore and the offset wells. Different choices for the X and Y coordinates may be made when displaying the misfit as a heat map. One choice is to display measured depth, $MD_{SW}$ on the X axis, while displaying stratigraphic vertical depth, $SVD_{OW}$ on the Y axis.

Figure 11A:
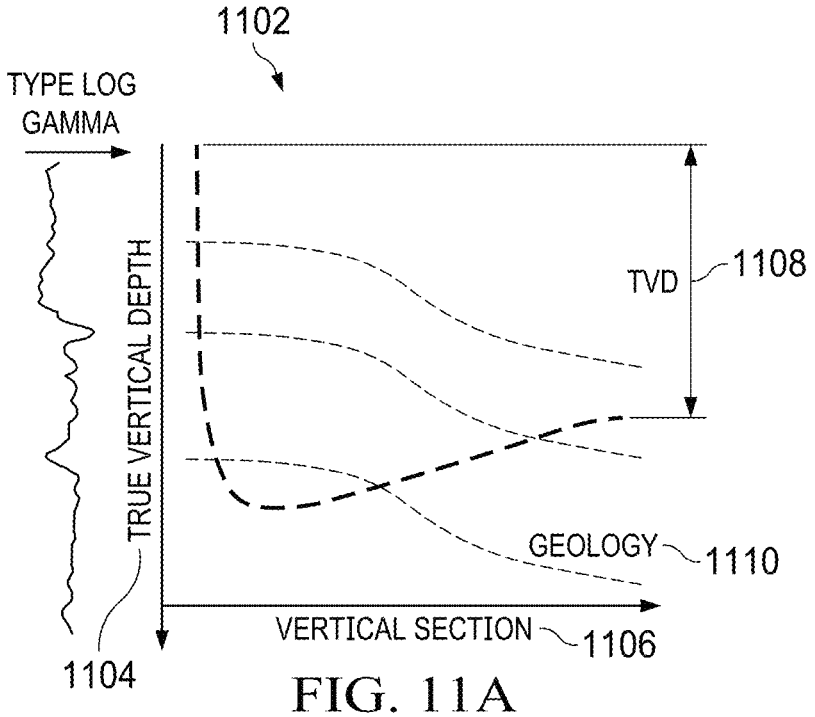
FIG. 11A (PRIOR ART)
FIG. 11A is a depiction of a conventional display of a vertical section of a wellbore, showing a gamma ray log and the wellbore and geology against true vertical depth.

FIG. 11A shows a conventional vertical section display 1102 of a wellbore, in which the X axis denotes the Vertical Section 1106 (distance from the wellhead in the direction of the virtual section azimuth) while the Y axis represents True Vertical Depth 1104. The True Vertical Depth of the specific wellbore 1108 is measured and compared to the true vertical depth of the geology 1110 represented by the stratigraphic layers. Stratigraphic layers may be shown as dashed horizontal lines, as illustrated in FIG. 11A.

Figure 11B:
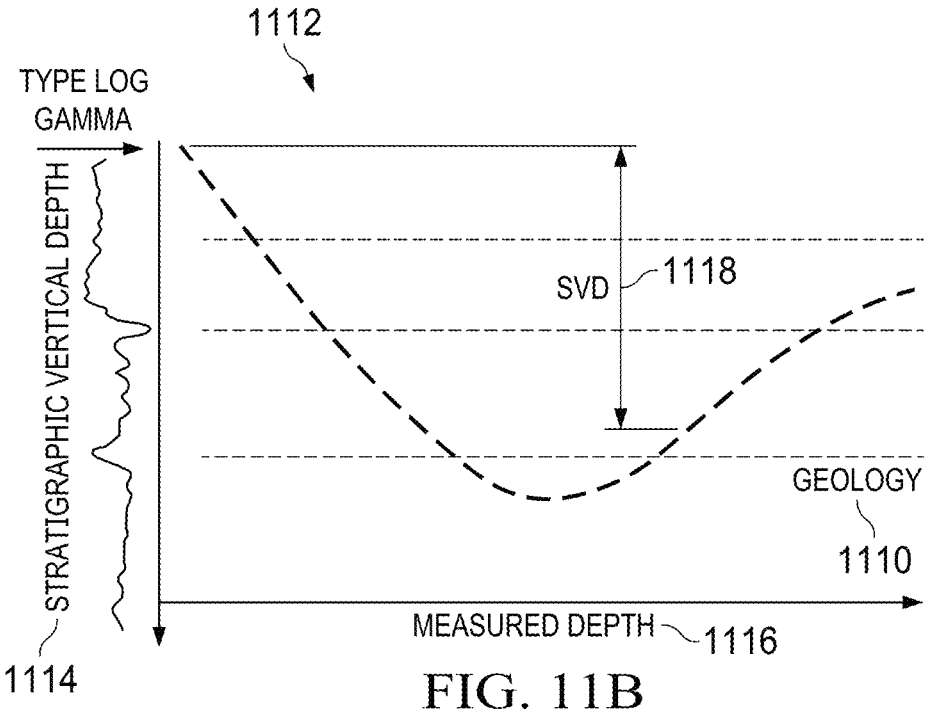
FIG. 11B is a depiction of a display of information (like that included in FIG. 11A) for a wellbore that is displayed with measured depth on the x-axis and stratigraphic vertical depth on the y-axis.

FIG. 11B illustrates a display 1112 that has been transformed (such as from the same data as displayed in FIG. 11A) to instead show the Measured Depth 1116 along the subject wellbore on the X axis and the Stratigraphic Vertical Depth, $SVD_{SW}$ 1114 on the Y axis. The Stratigraphic Vertical Depth, $SVD_{SW}$ of the specific wellbore 1118 is measured and compared to the Stratigraphic Vertical Depth, SVD of geological formations 1110. FIG. 11B shows the case where only a single offset well log is used for reference. This corresponds to assuming a 1D geomodel with horizontal horizons, as shown by the horizontal dashed lines. The advantage of showing measured depth, $MD_{SW}$ on the X axis is that every point on the X axis is then uniquely associated with only one point along the subject wellbore. This helps display misfit heatmaps because every point in the heat map is then associated with only one measured depth.

Figure 12:
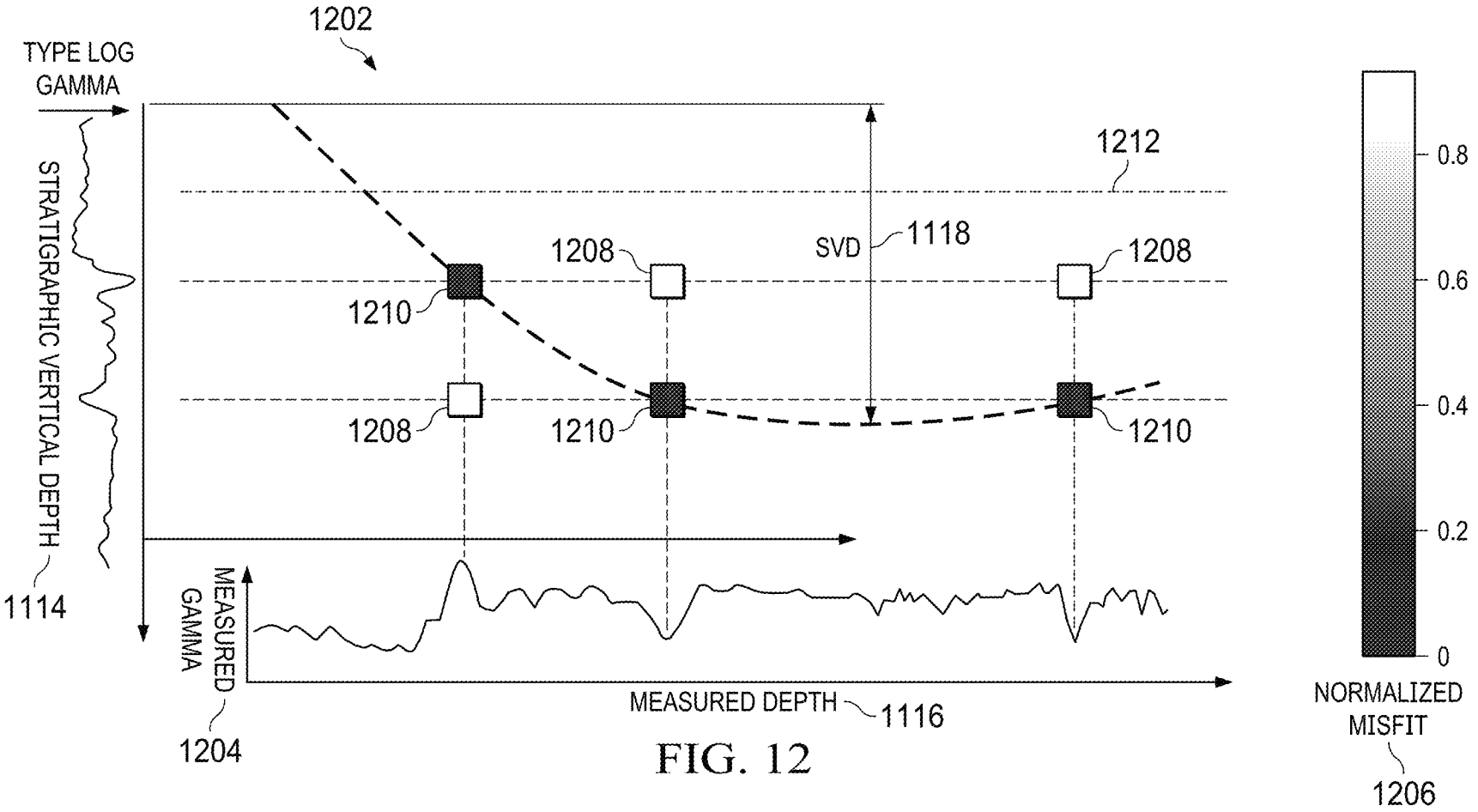
FIG. 12 is a depiction of a simple form of stratigraphic misfit heat map in accordance with the present disclosure.

FIG. 12 illustrates a simple form of a stratigraphic misfit heat map 1202, for a single offset wellbore and assumed 1D geomodel with flat stratigraphic layers (horizontal dashed lines) 1212. With Measured Depth 1116 plotted on the X axis and stratigraphic vertical depth 1114 on the Y axis, every (x,y) coordinate corresponds to a pair of depths, one on the subject well and one on the offset well. The misfit between those two points is the normalized misfit 1206, which can then be color coded, for example with a dark color for low misfit and a bright color for high misfit, resulting in a stratigraphic misfit heatmap. In this heat map 1202, the dark points 1210 and the light points 1208 represent the normalized misfit 1206 values. The measured gamma 1204 is displayed for the user below the heat map 1202. It is to be noted that the heat map 1202 may include a variety of colors and/or brightness levels, such as bright red for a high misfit value and dark blue for a low misfit value, with colors of the spectrum (e.g., green, yellow, orange, etc.) representing intermediate misfit values.

Figure 13:
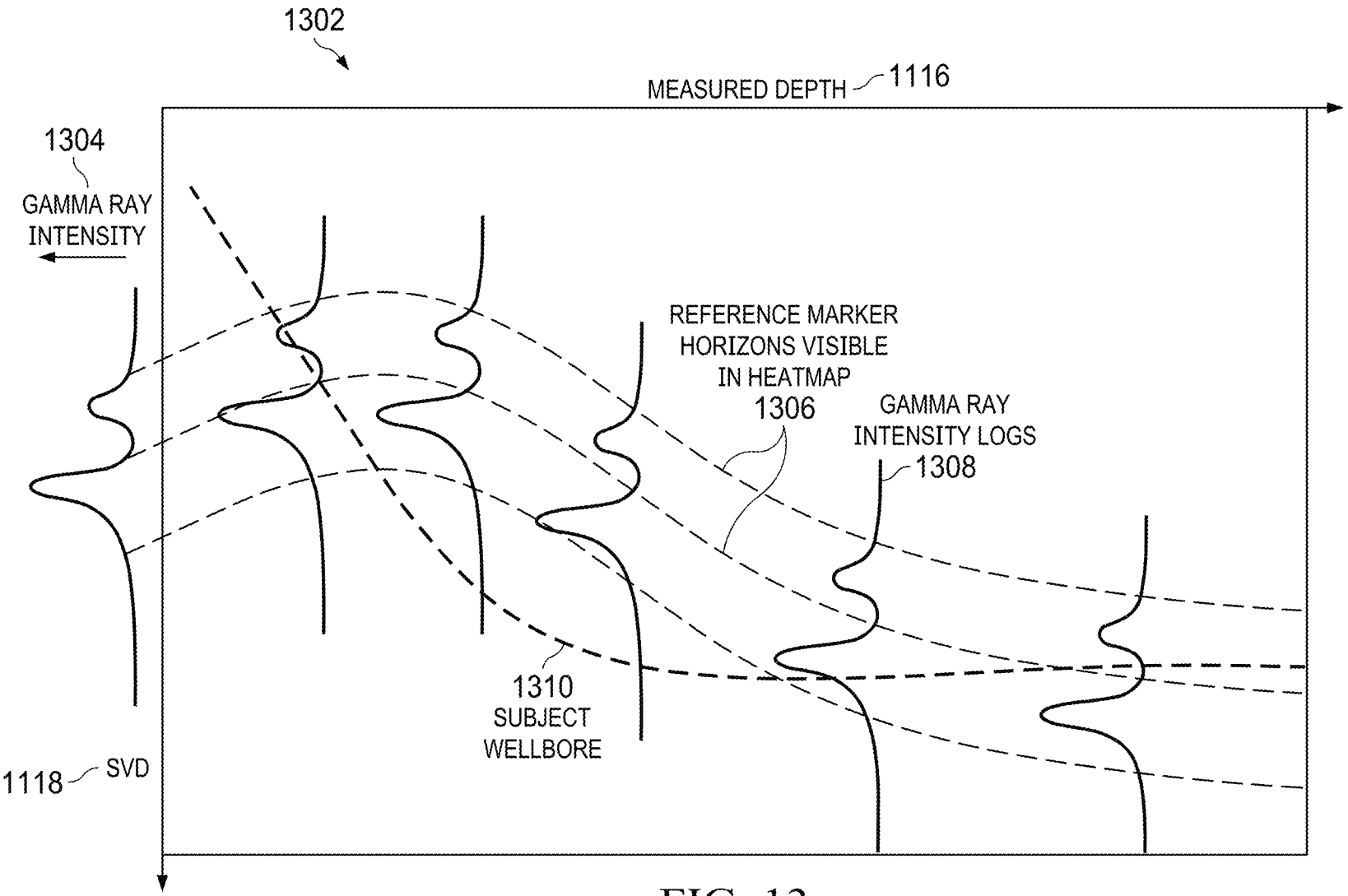
FIG. 13 is a depiction of a 3D geomodel in accordance with the present disclosure.

FIG. 13 shows the measured depth, $MD_{SW}$/Stratigraphic Vertical Depth, $SVD_{OW}$ MD/SVD display 1302 for a hypothetical 3D geomodel. The geomodel is defined by marker horizons 1306 that connect the markers of multiple offset well logs, which may be gamma ray intensity logs 1308. The 3D geomodel maps the Stratigraphic Vertical Depth, $SVD_{OW}$ 1118 for any measured depth, $MD_{SW}$ 1116 point along the wellbore to the corresponding SVD points on each of the offset wells. This enables, for example, comparison of the gamma ray intensity 1304 measured on the subject well 1310 with all of the corresponding values on the offset wells simultaneously. The combined misfit of the subject well against the offset wells is subsequently plotted as a stratigraphic misfit heatmap (not shown here).

Figure 14:
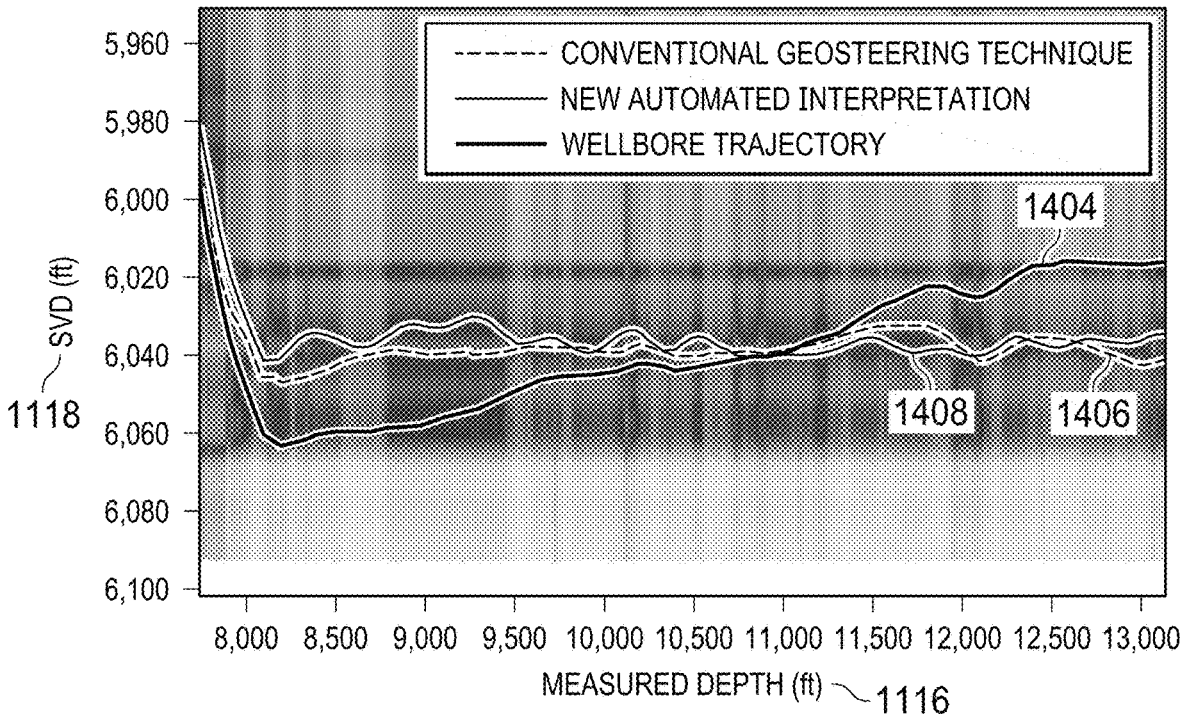
FIG. 14 illustrates a heat map in accordance with the present disclosure.

FIG. 14 shows a heat map 1402 plotted in measured depth, $MD_{SW}$ vs. stratigraphic vertical depth, $TVD_{OW}$ for single offset well (1D geomodel). The stratigraphic horizons appear as horizontal stripes. The wellbore trajectory 1404 is plotted, along with the interpretation thereof using a conventional geosteering technique 1406, and the new automated interpretation 1408. A heat map display like those shown and described herein enables the visual or automated identification of interpretation paths corresponding to misfit value, MV. Such a path with the lowest misfit between subject and offset well measurements specifies a continuous interpretation of the stratigraphic depth along the wellbore. In addition, the surveyed wellbore trajectory can be displayed by plotting its true vertical depth, $TVD_{OW}$ as stratigraphic vertical depth, $SVD_{OW}$ 1118. The heat map then shows the misfit in stratigraphy between the subject well and offset wellbore. If the pre-drill geomodel and the surveyed true vertical depth, $TVD_{OW}$ of the wellbore are both accurate, the true vertical depth, $TVD_{OW}$ of the wellbore is identical to the stratigraphic vertical depth, $SVD_{OW}$ 1118. Consequently, the wellbore will coincide with a path of minimal misfit in the heat map. Due to errors in the geomodel and the surveyed wellbore position, it is however more likely that the path of minimal misfit is displaced from the wellbore trajectory. For example, if the surveyed wellbore lies below the path of minimum misfit, it means that the actual stratigraphic depth is shallower, requiring a downward steering correction to achieve the intended stratigraphic depth.

Figure 15:
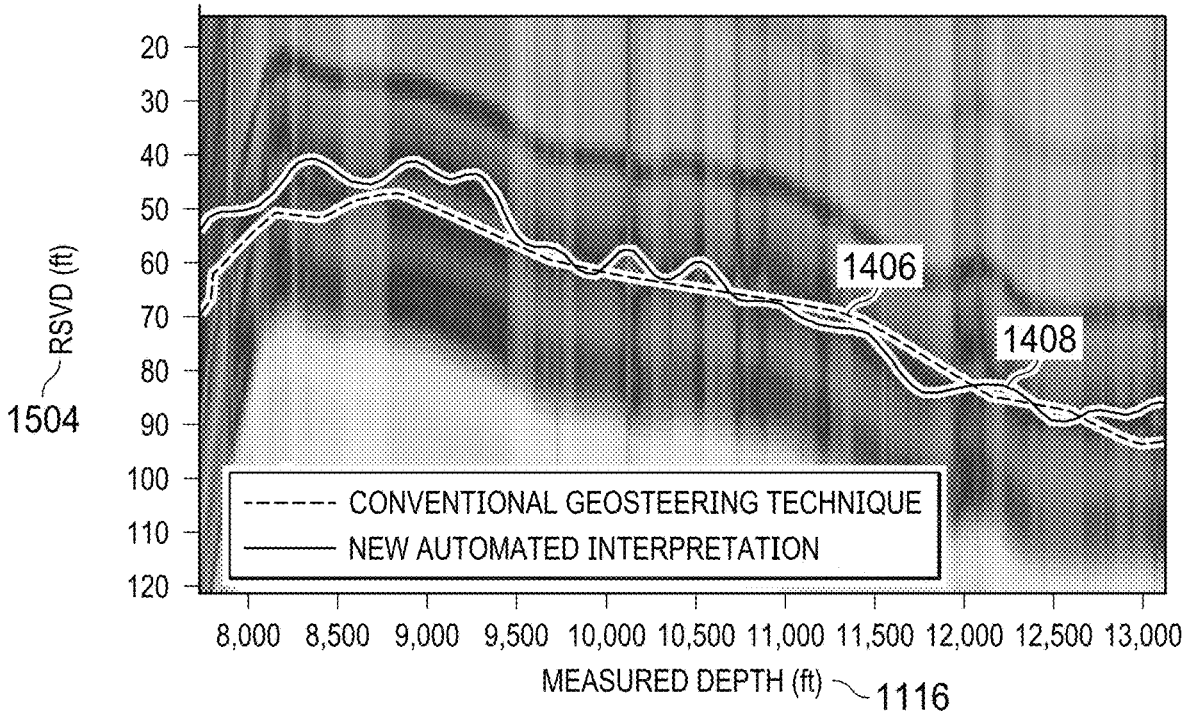
FIG. 15 illustrates an alternative type of heat map in accordance with the present disclosure.

To directly illustrate the deviation between actual and supposed stratigraphic depth, another possible choice is to display measured depth, $MD_{SW}$ on the X axis, while displaying the Relative Stratigraphic Vertical Depth, $RSVD_{OW}=SVD_{OW}-TVD_{OW}$ on the Y axis. FIG. 15 illustrates a stratigraphic misfit heat map 1502 for the same well as in FIG. 14, but displayed using a measured depth, $MD_{SW}$ vs. Relative Stratigraphic Vertical Depth, $RSVD_{OW}$ plot. In FIG. 15, the wellbore true vertical depth, $TVD_{OW}$ has been subtracted from the stratigraphic vertical depth, $SVD_{OW}$, so that the Y axis shows the difference between the correction of the stratigraphic vertical depth, $SVD_{OW}$ relative to the true vertical depth, $TVD_{OW}$ of the wellbore, or the Relative Stratigraphic Vertical Depth, $RSVD_{OW}$ 1504. A previous manual conventional interpretation using the stratigraphic misfit heat map methods disclosed herein.

The heat map shows the misfit in stratigraphy between the subject and offset wellbores as a function of a vertical displacement between the actual and supposed stratigraphic depth. For the ideal situation of an accurate geomodel and accurately surveyed wellbore trajectory, the path of minimum misfit would follow the Y=0 line. In this case, a visual or automated identification of interpretation paths as a function of measured depth, $MD_{SW}$ and Relative Stratigraphic Vertical Depth, $RSVD_{OW}$ with the lowest misfit then specifies a continuous correction of the stratigraphic depth along the wellbore, relative to the stratigraphic depth given by the geomodel.

An optimal interpretation can be identified as a path $SVD_{SW}$ with minimal cumulative misfit for all the points along the path. Instead of simply adding the misfits along the path, it may be advantageous to compute the misfit of the path as a whole, further taking the correlation between subsequent measurements into account. This can be achieved by computing the pathwise misfit $M(path)=D^T COV^{-1} D$, where D is the vector of all differences between subject and offset well measurements along the interpretation path and $COV^{-1}$ is the inverse of the covariance matrix for all pairs of pointwise misfits along the interpretation path. Depending on the correlation between subsequent measurements, the path with the lowest pathwise misfit may not coincide with the lowest integrated pointwise misfit over the measured depth, $MD_{SW}$ range. The concept of pathwise misfit can be extended into a cost function, where the cost takes further undesirable attributes into account, such as strong formation curvature or large fault offsets. For example, an interpretation that assumes multiple large faults may have low misfit, but a higher cost. These considerations may be quantitatively incorporated into a Bayesian prior that penalizes paths that are deemed unlikely from knowledge gained about the underlying formation prior to drilling.

Figure 16:
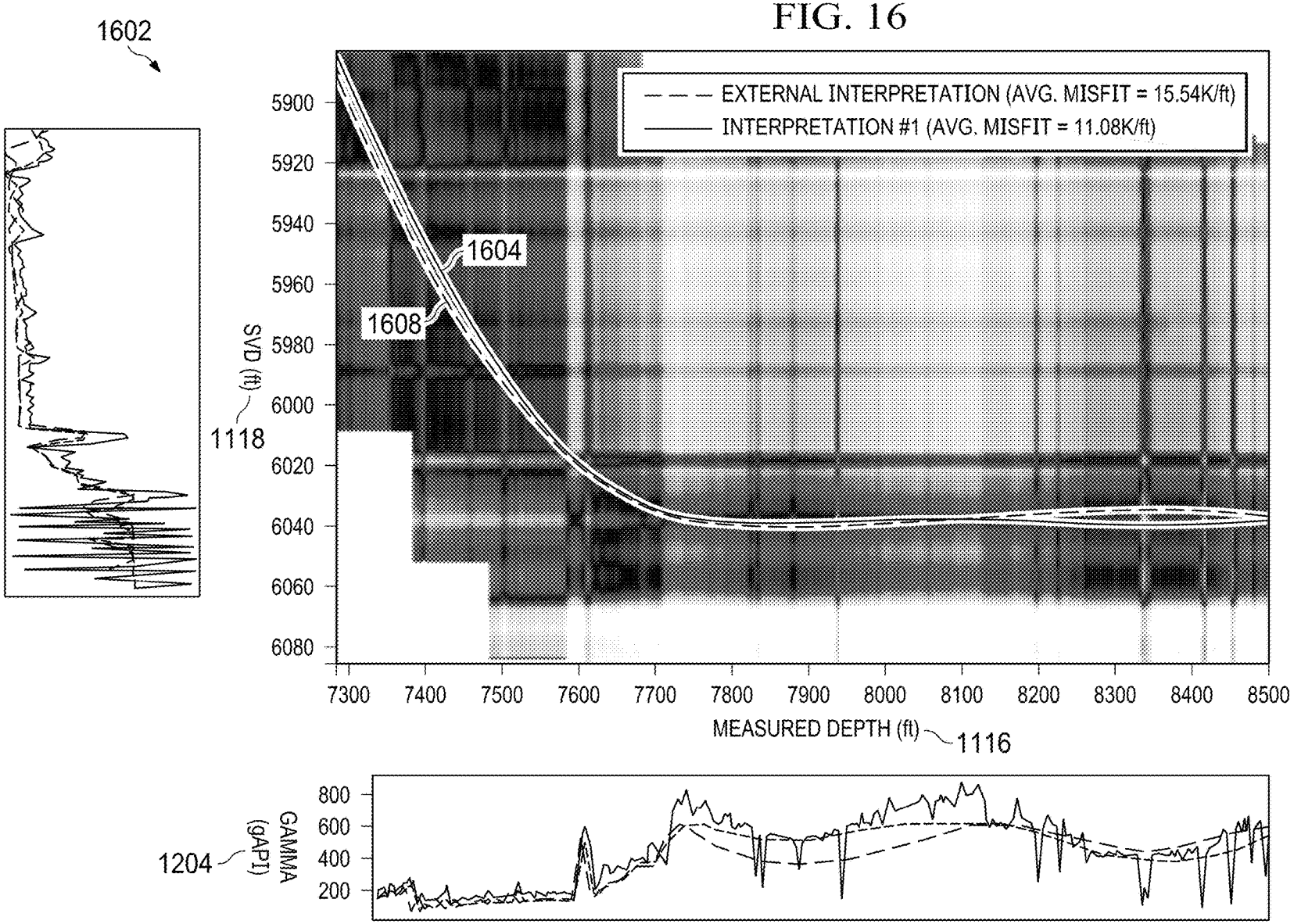
FIG. 16 illustrates a comparison of a well borehole interpretation using an automated heat map analysis versus a well borehole interpretation using a conventional technique.

An algorithm can be employed by a computer system to automatically determine paths $SVD_{SW}$ of minimal cost. Any such path constitutes a possible interpretation of the vertical stratigraphic offset between the subject wellbore and geomodel. The path can be parameterized using any suitable basis functions, such as harmonic functions or splines. Finding a path with lowest cost then translates into finding the optimal parameters of the representation of the path. The prior covariances of the coefficients can be computed empirically by generating a large number of random realizations governed by the Bayesian prior model and estimating the resulting parameter covariances. Possible algorithms for finding the parameters for the optimal $SVD_{SW}$ paths include maximum a posteriori estimation, least squares and optimization methods from graph theory. Due to the stochastic nature of the geosteering problem, one or multiple optimal paths can be displayed on the heat map display to enable quality control by the user. A heat map display 1602 with corresponding vertical and horizontal correlation plots is shown in FIG. 16. FIG. 16 shows a fully automated interpretation 1604 of heat map against a previous interpretation using a conventional manual geosteering technique 1608.

Stratigraphic information along a wellbore can directly be inferred from sensor data, such gamma ray, neutron density, electrical resistivity and acoustic velocity. On the other hand, stratigraphic information may also be inferred from drilling dynamics data, such as changes in the rate of penetration, torque, weight on bit, mechanical specific energy, vibrations, differential mud pressure, and combinations of the foregoing. Further ancillary information may be available from monitoring the composition of the drilling fluid returning from down hole. The following discusses the use of drilling dynamics data in more detail.

For each offset wellbore, common data channels can be identified. For example, one offset wellbore may only have gamma log data, while another may additionally have drilling dynamics data. A characteristic function is then defined specific to the given set of data channels. For example, this may be a linear combination of the channels, which optimally weights the contribution of each channel. Using the same formula, a characteristic function along the wellbore can then be computed for the subject wellbore as well as for the offset wellbore. The characteristic function $F^{subj}(MD_{SW})$ for the subject wellbore can be parameterized by measured depth, $MD_{SW}$, while the characteristic function $F^{offset}(TVD_{OW})$ for the offset wellbore is parameterized by the true vertical depth, $TVD_{OW}$, along the offset wellbore. Since the available channels may differ between different offset wellbores, one pair of characteristic functions $F^{subj}(MD_{SW})$, $F^{offset}(TVD_{OW})$ can be computed for each offset wellbore.

The characteristic function of an offset well can be projected to any location on the subject well using a 3D stratigraphic model. Instead of interpreting against a separate characteristic function for every offset wellbore, one may instead combine the characteristic functions of multiple offset wellbores into a single characteristic function (also called typelog) at any location along the subject wellbore.

It may also be possible to use data channels that are not common to both the subject well and the offset well. For example, the offset wellbore may have no drilling dynamics data but may instead include data from an acoustic logging tool from which a user or computer system can infer the hardness of the rock, especially when such information is taken together with information regarding measured depth, $MD_{SW}$ and/or true vertical depth, $TVD_{OW}$, and information regarding geological formation(s) expected or already encountered by the well, such as may be included in the well plan. The drilling dynamics data channels from the subject well can then provide a measure of rock hardness that can then be related to the rock hardness estimated from the acoustic data channels of the offset well.

A heat map may be used to display the difference between the characteristic functions of the subject wellbore and an offset wellbore as a measure of the stratigraphic misfit. As a measure of the difference one may use any of the norms commonly used in data analysis, such as the relative difference computed as:

$$\text{Misfit}(MD_{SW}, TVD_{OW}) = |F^{subj}(MD_{SW}) - F^{offset}(TVD_{OW})| / |F^{subj}(MD_{SW}) + F^{offset}(TVD_{OW})|$$

Here, measured depth, $MD_{SW}$ is taken along the subject wellbore, whereas true vertical depth, $TVD_{OW}$ is taken along the offset wellbore.

Different choices for the X and Y coordinates may be made when displaying the misfit function as a heat map. One possible choice is to display measured depth, $MD_{SW}$ on the X axis, while displaying the difference in true vertical depth, TVD between the subject wellbore and the offset wellbore (δTVD) on the Y axis. The heat map then shows the misfit in stratigraphy between the subject and offset wellbores as a function of a vertical displacement. The heat map enables the visual or automated identification of paths ($MD_{SW}$, δTVD) with the lowest misfit. Such a path with the lowest misfit then identifies the vertical stratigraphic displacement between the two locations. If the offset wellbores had been combined into a single characteristic function using a 3D stratigraphic model, then the path of minimal misfit shows the vertical displacement of the true stratigraphic depth from the stratigraphic model depth at the location of the subject wellbore.

Figure 17:
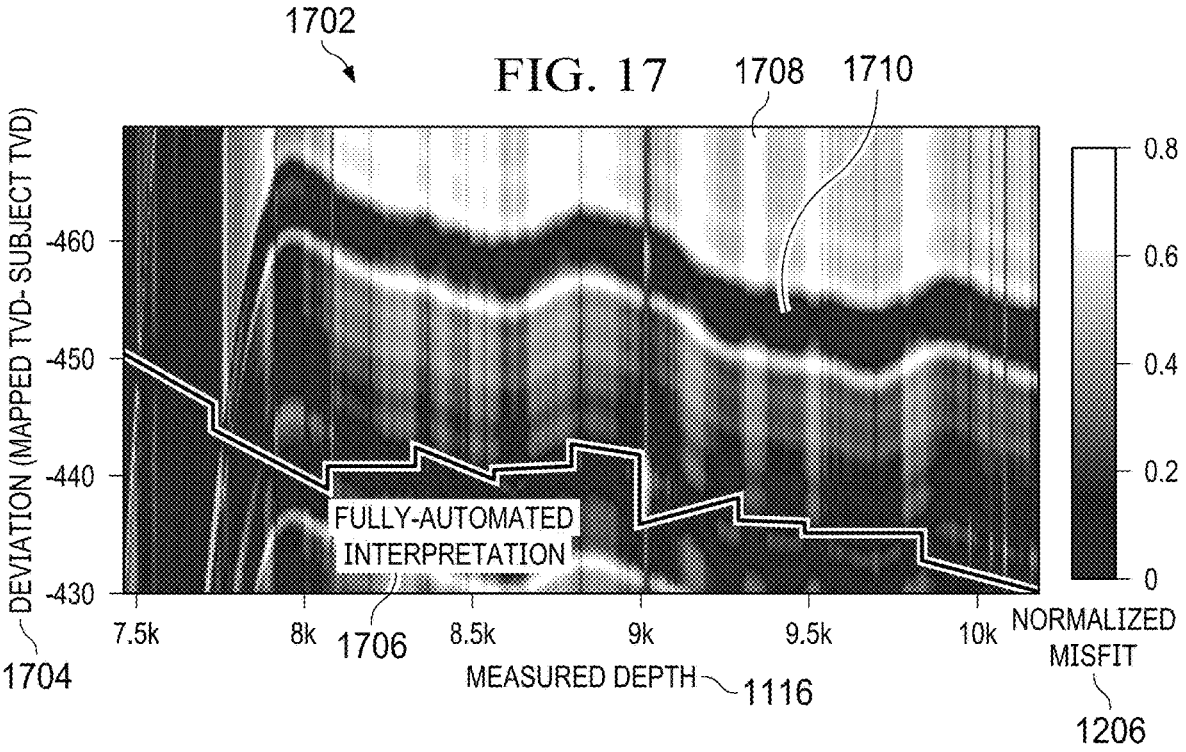
FIG. 17 is a 3D plot of a least squares estimation for linear segments.

An algorithm can be employed on a computer system to automatically determine and/or follow the peaks or valleys in the heat map. Any such valley constitutes a possible interpretation of the vertical stratigraphic offset between the subject wellbore and the offset wells or the between the subject wellbore and the stratigraphic model. Possible algorithms to identify valleys, for example, include maximum likelihood estimation, least squares and optimization methods from graph theory. The problem can be considered similar to tracking streams in topographical maps or finding the quickest route to a destination and can be solved using well known methods. After identifying one or multiple paths, the solutions can be displayed on the heat map to enable quality control by the user. A simple example showing the result of using least squares estimation for linear segments is shown in FIG. 17. The display 1702 shown in FIG. 17 can be automatically generated and displayed by a computer system using data obtained from a wellbore being drilled. The deviation between the mapped true vertical depth, $TVD_{OW}$ and the subject wellbore true vertical depth, $TVD_{SW}$ 1704 is plotted against the measured depth 1116. The fully-automated interpretation 1706 is plotted over the heat map shown on the display 1702. The normalized misfit 1206 is measured on the heat map, wherein the light area 1708 represents a high normalized misfit 1206 and the dark area 1710 represents a low normalized misfit 1206. An improved display may be achieved by using splines to account for curvature of the well trajectory and the geological formation of interest. It is to be noted that the heat map 1202 may include a variety of colors and/or brightness levels, such as bright red for a high misfit value and dark blue for a low misfit value, with colors of the spectrum (e.g., green, yellow, orange, etc.) representing intermediate misfit values.

Figure 18:
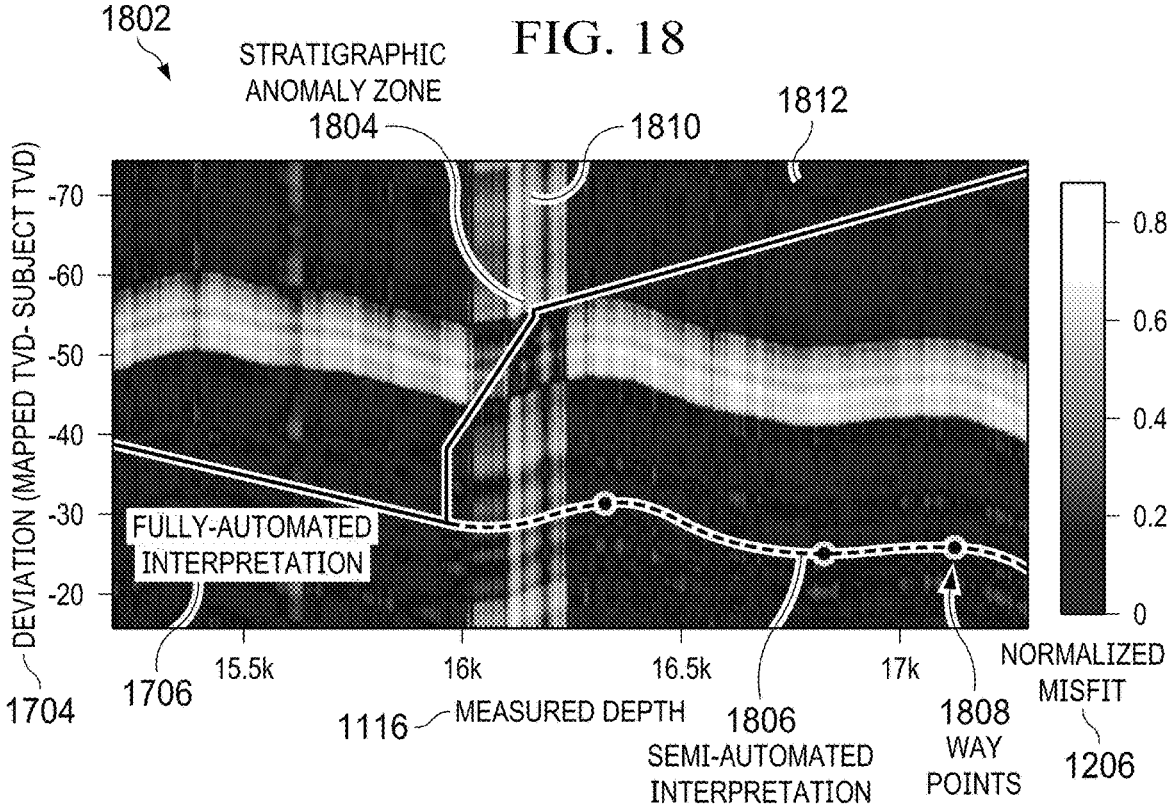
FIG. 18 is a 3D plot of a semi-automated interpretation using way points.

The fully automated algorithm may not always identify the correct path, due to stratigraphic anomalies and noise in the data. Human expert intervention may therefore be required to guide the automated interpretation. One possibility is to set user-defined way points through which the path must pass. The automated algorithm may then be constrained to only consider paths passing through these way points. This may be called a semi-automated interpretation. An example of such a semi-automated interpretation using way points in shown in FIG. 18. The display 1802 shown in FIG. 18 displays a fully-automated interpretation 1706 and a semi-automated interpretation 1806. The semi-automated interpretation 1806 features way points 1808. The normalized misfit 1206 is measured on the heat map, wherein the light area 1810 represents a high normalized misfit 1206 and the dark area 1812 represents a low normalized misfit 1206. The heat map also shows a stratigraphic anomaly zone 1804. It is to be noted that the heat map 1202 may include a variety of colors and/or brightness levels, such as bright red for a high misfit value and dark blue for a low misfit value, with colors of the spectrum (e.g., green, yellow, orange, etc.) representing intermediate misfit values.

It is also possible to use heat maps for an entirely manual interpretation without any automation. An example is shown in FIG. 19. The display 1902 shown in FIG. 19 displays a fully-automated interpretation 1706 and a manual interpretation 1904. The display 1902 also includes plotted marker 1 1906 and plotted marker 2 1908. The normalized misfit 1206 is measured on the heat map, wherein the light area 1910 represents a high normalized misfit 1206 and the dark area 1912 represents a low normalized misfit 1206. It is to be noted that the heat map 1202 may include a variety of colors and/or brightness levels, such as bright red for a high misfit value and dark blue for a low misfit value, with colors of the spectrum (e.g., green, yellow, orange, etc.) representing intermediate misfit values. The manual interpretation of a single or combined heat map could include the following steps:

(1) Display the heat map with the Y axis centered on the most likely δTVD, as inferred for example from a 3D stratigraphic model linking the subject wellbore stratigraphy to the offset wellbore stratigraphy.

(2) Add lines for geological formation or marker horizons (1906 and 1908) and label these.

(3) Determine paths through valleys of low heat, corresponding to good stratigraphic agreement between the subject wellbore and the offset data. These valleys are the possible interpretations.

(4) Employ a user interface, UI to define one or multiple paths along the selected valleys.

(5) Export the paths as stratigraphic interpretations, such as may be used to adjust a drill plan and/or adjust drilling operations to drill to a target formation.

Multiple heat maps may be displayed simultaneously along the subject wellbore using 3D visualization. A suitable user interface, for example using a game controller (e.g., an Xbox controller), may be used to set way points or define manual interpretations in a 3D display. An illustration of this approach is shown in FIG. 20. The user interface 2002 features a heat map for typelog 1 2006 and a heat map for typelog 2 2008. The heat map for typelog 1 2006 and a heat map for typelog 2 2008 cross one another at the subject wellbore 2004. The typelog 1 2010 and typelog 2 2012 are combined to create a combined typelog 2014. Note that in the lateral section of the subject well the display of TVD as a vertical offset is intuitive. However, in the vertical section, measured depth, $MD_{SW}$ progresses downward. While TVD is displayed horizontally, it also refers to the vertical direction. The user interface should be designed to intuitively communicate this to the user.

By analyzing the heat map image to identify zones of low misfit, interpretations can be constrained to the most promising regions. This can significantly speed up the automated interpretation by a computer system by constraining the region in which it is to search for solutions. The image analysis may also identify connected channels which are indicative of potential interpretations.

The result of the heat map interpretation is a mapping from the measured depth, $MD_{SW}$ of the subject wellbore to the stratigraphy defined by offset wellbores or a 3D stratigraphic model. This information allows the user (or automated steering system) to determine the stratigraphic position of the wellbore and to make real-time corrections to the wellbore while it is being drilled to optimally steer the wellbore to the geological target and keep the wellbore in the stratigraphic target zone.

The generation, display, and use of the heat map interpretation, including uses such as updating the well plan and/or altering or adjusting one or more drilling parameters to drill to the target zone and/or stay in the target zone, including automatically or in a semi-automatic fashion, may be done with a programmed computer system which may be connected to one or more of the drilling rig control systems, such as described above, including steering control system 168 or CGL 900.

Drilling dynamics parameters carry information about rock properties. However, this geological information must be separated from noise and unrelated drilling events. Described here are methods and systems to optimally extract the geological information from the various drilling dynamics parameters in such a way that the geological specificity is maximized and can be used.

Drilling dynamics data from previously drilled wells can be used to infer an optimal combination of re-scaled parameters to enhance the common geology signal. The data can be processed in the following way:

1. Identify existing wellbores which have one or multiple adjacent wellbores. All wells ideally will have the same drilling dynamics parameters to be used when steering a new wellbore.
2. When extracting the drilling dynamics parameters from the wellbore database, also extract the Gamma. Then adjust the measured depth of the Gamma ray measurements for the distance between the Gamma sensor and the bit, so that all parameters are referenced to the measured depth of the bit.
3. Optionally compute derivative parameters such as the Mechanical Specific Energy, MSE.

4. Using the Gamma ray values for each well, identify marker horizons indicating a specific stratigraphic depth. Use the marker horizons to "flatten" the true vertical depth, TVD between the wells. This can be achieved by choosing one well as the primary well and adjusting the true vertical depths, TVDs of the other wells in such a way that their markers line up with the primary well.

5. Analyze the statistical distribution of each drilling parameter, for example by plotting histograms of the data from prior wells. Histograms show skewness in the distribution and they can be used to identify multiple populations, arising for example from different drilling modes. It may also be important to identify any non-stationarity of the parameters, such as trends of the mean and/or the variance with increasing measured depth, $MD_{SW}$.

6. Prior to incorporating the drilling dynamics data, it is advantageous to transform such data into stationary normal distributed parameters with zero mean and unit variance. This typically involves (a) breaking up multiple populations, such as periods of rotary drilling versus slide drilling, (b) removal of trends, (c) eliminating skewness in the distribution and (d) removing outliers. Essentially, a function generally should be defined for each drilling parameter that approximately maps it to a stationary random series following a Gaussian normal distribution with zero mean and unit variance.

7. The same clean-up and transformation data may also be advisable for Gamma and any other logging data.

Once the drilling parameters have been transformed into an equivalent number of parameters with zero mean and unit variance, one can infer the optimal linear combination of the re-scaled parameters using a statistical model as follows.

Let us assume that the drilling dynamics data vectors X(TVD) and Y(TVD) of two wells are the sum of a common geology signal vector G(TVD) and uncorrelated noise U(TVD) and V(TVD):

$$X(TVD)=G(TVD)+U(TVD)$$

$$Y(TVD)=G(TVD)+V(TVD)$$

The covariance matrix cov(G) can then be computed as:

$$<X_i,Y_j>=<G_i,G_j>+<G_i,V_j>+<U_i,G_j>+<U_i,V_j>=<G_i,G_j>=<\mathrm{cov}(G)>$$

Where < > denotes statistical expectation. Thus, the covariance matrix of the common geology signal vector G(TVD) can be estimated from the covariance between the drilling parameters of adjacent wells. To make the estimated covariance matrix symmetric for a pair of wells:

$$<\mathrm{cov}(G)_{ij}>=\tfrac{1}{2}(<X_i,Y_j>+<Y_i,X_j>)$$

In case there are more than two adjacent wells available, the covariance matrix of the common geology signal can be estimated from the average over all possible combinations of pairs of wells.

The stratigraphic misfit heat map displays the misfit between the vector a of parameter values of the subject well against the corresponding vector b of parameter values of the offset well. These parameters can include for example rescaled gamma measurements as well as rescaled drilling dynamics parameters. Given the covariance matrix cov(G) of the common geology vector, we can then define the stratigraphic misfit between a and b as:

$$|a-b|=((a-b)^T\,\mathrm{cov}(G)(a-b))^{1/2}$$

This allows a wide range of parameters to be included into the misfit heat map to make use of all relevant information to optimally display an accurate and helpful heat map and to steer the wellbore into the desired target formation.

In summary, various reference data from reference wells may be used to generate stratigraphic misfit heat maps that enable analysis of actual log data from a well being drilled. Generation of the heat maps may include an analysis of drilling dynamics parameters to identify multiple populations, trends, drift, skewness, and to eliminate outliers. The data logs from the reference data may be transformed into stationary normal distributed random variables. Certain statistical properties of a common geology vector may be identified by cross-correlation of data logs from one or more reference wells. A covariance matrix (cov(G)) of the common geology vector may be estimated. The covariance matrix may be used to define a stratigraphic misfit between data logs of the well being drilled and the one or more reference wells. The data logs combined with the common geology vector may be displayed and analyzed using 3D stratigraphic misfit heat maps. From the stratigraphic misfit heat map, a most likely stratigraphic trajectory of the well being drilled may be obtained, such as in one example from a valley of the minimum misfit in the heat map.

At any measured depth, $MD_{SW}$ on the subject well, stratigraphic heat maps can be used to infer a likelihood of the wellbore being at a particular stratigraphic depth. Furthermore, the probability-weighted stratigraphic depth, the most likely depth, and the uncertainty of depth can be inferred by performing the following operations.

- Select a starting measured depth, MD1 on the subject wellbore. Measured depth, MD1 could be, for example, the wellhead, a uniquely identified crossing of a stratigraphic marker or crossing of a stratigraphic fault.
- Identify possible interpretations of sequences of stratigraphic depth along the wellbore, corresponding to valleys in the stratigraphic heat map.
- Order the interpretations by their stratigraphic vertical depth, SVDi(MDL) at the target measured depth, MDL. Different interpretations can end up at approximately the same stratigraphic vertical depth, SVD at the target measured depth, MDL. Treat all interpretations with similar stratigraphic vertical depth, SVD as a subset. Index these subsets with different stratigraphic vertical depths, SVDj(MDL) by the index j=1 . . . M, where M≤N is the number of such subsets. The average stratigraphic vertical depth, SVDj(MDL) of each subset j is given by SVDj=Av(SVDi(MDL) where the average is over all interpretations i in subset j.
- The likelihood P(SVDj) of the subject wellbore being at the particular stratigraphic vertical depth, SVDj at the target measured depth, MDL can then be inferred from the cumulative misfits as
- P(SVDj)=Sumi(f(Mi)|i belongs to subset j)/Sumi(f(Mi)), where f(Mi) is a suitable function of the misfit, which increases as the misfit decreases, such as its reciprocal value. The first sum is over the interpretations in the subset, while the second sum is over all interpretations.
- The probability-weighted average stratigraphic vertical depth, SVDp is then given by
- SVDp=Sumj(SVDj P(SVDj))
- Note that this depth could inadvertently fall between two valleys in the heat map onto a peak with maximum misfit.
- The stratigraphic depth with the highest likelihood is given by
- SVDML=(SVDj where P(SVDj) is largest)
- Uncertainty of depth can then be computed as
- $\mathrm{sigma(SVD)}=(\mathrm{Sumj(P(SVDj)\ (SVDj-SVDp)2)})^{1/2}$ These discrete values at the stratigraphic vertical depths, SVDj of the interpretation subsets j can be extrapolated into a continuous probability density p(SVD) by the following further steps:

Define a modified path (MDk, SVDi, dSVD(MDk)) for interpretation i belonging to subset j as depicted in FIG. 17, which also explains the computation of the likelihood of depth:

Starting at measured depth, $MD_L$, decrease the index k until reaching the last inflection point measured depth, $MD_{Inf}$. The last inflection point being defined as the last point (highest k) where the second derivative $$D''(k)=SVD_i(MD_{k-1})-2SVD_i(MD_k)+SVD_i(MD_{k+1})$$

changes sign from D"(k−1) to D"(k), which is equivalent to the product being negative:

$$D''(k-1)D''(k)<0.$$

For the given modification dSVD, define a modified path as:

$$\text{For } MD_k<MD_{Inf}\text{: } SVD_{i,dSVD}(MD_k)=SVD_i(MD_k)$$

$$\text{For } MD_k\geq MD_{Inf}\text{: } SVD_{i,dSVD}(MD_k)=SVD_i(MD_k)+(MD_k-MD_{inf})/(MD_L-MD_{inf})\text{dSVD}$$

Compute the misfit $M_{i,dSVD}$ of the modified path $$M_{i,dSVD}=\text{sum}(M(MD_k,SVD_{i,dSVD}(MD_k))$$

Specify the range stratigraphic vertical depth, SVDmin to stratigraphic vertical depth, SVDmax in which the probability density p(SVD) is defined:

Define $SVD_{min}=SVD_0=SVD_1-SVD_C$, where $SVD_C$ is a chosen constant offset with a magnitude similar to a typical SVD offset between two adjacent subsets of interpretations.

$$\text{Define } SVD_{max}=SVD_{M+1}=SVD_M+SVD_C$$

Select the range of modified paths for each interpretation i belonging to subset j as the stratigraphic vertical depth, SVD interval as SVDj−1 to SVDj+1.

Define the total value of the function f( ) of the misfit $M_{i,dSVD}$ as:

$$f_{total}=\text{Sum}_i(\text{integral}(f(M_{i,dSVD})\text{dSVD}),$$

where the sum is over all interpretations i. The integral is over the interval from $SVD_{j-1}$ to $SVD_{j+1}$, where j is index of the subset that the interpretation i belongs to. This integral can be substituted by a discrete sum over small enough increments of dSVD.

Define the probability density p(SVD) as:

$$p(SVD)=\text{sum}_i(f(M_{i,dSVD}),\text{ if } SVD_{j-1}<SVD<SVD_{j+1})/f_{total}$$

The probability-weighted mean stratigraphic depth is then given by $$SVD_p=\text{integral}(SVD\ p(SVD))$$

Note that this depth could fall between two valleys in the heat map onto a peak with maximum misfit.

The stratigraphic depth with the highest likelihood is given by $$SVD_{ML}=(SVD \text{ where } p(SVD) \text{ is largest})$$

The uncertainty of stratigraphic depth can then be computed as $$\text{sigma}(SVD)=(\text{integral}((SVD-SVD_p)^2p(SVD)))^{1/2}$$

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A method of geosteering a well, the method comprising:

taking measurements at a plurality of measured depths, $MD_{sw}$ along a borehole of a subject well being drilled;

selecting an offset well log with measurements at a plurality of stratigraphic vertical depths, $SVD_{ow}$;

computing a misfit value, MV for each of a plurality of pairs of measurements of the subject well at measured depths, $MD_{sw}$ and the offset well at stratigraphic vertical depths, $SVD_{ow}$ as a function of these two parameters as follows: misfit value, $MV=f(MD_{sw},SVD_{ow})$, and wherein a stochastic model is used to characterize the misfit value;

determining, responsive to the computed misfit value, a stratigraphic vertical depth, $SVD_{sw}$ of the subject well at the measured depths, $MD_{sw}$; and drilling the borehole of the subject well responsive to the determined stratigraphic vertical depth, $SVD_{sw}$ to a target stratigraphic vertical depth of the subject well, $TSVD_{sw}$.

2. The method according to claim 1, wherein the misfit value, MV is computed using a plurality of offset well logs and the method further comprises:

taking a plurality of measurements at the plurality of measured depths, $MD_{sw}$ along the borehole of the subject well;

selecting a plurality of offset well logs, each having a plurality of measurements at true vertical depths, $TVD_{ow}$;

generating a mapping of true vertical depths, $TVD_{ow}$ against stratigraphic vertical depths, $SVD_{ow}$, wherein the mapping relates the stratigraphic vertical depths, $SVD_{ow}$ to the corresponding true vertical depths, $TVD_{ow}$ of the plurality of offset well logs;

computing a combined Misfit value, $MV_c$ for each of the measurements at measured depths, $MD_{sw}$ of the borehole of the subject well, and offset measurements of true vertical depths, $TVD_{ow}$ of all of the plurality of offset well logs;

determining, responsive to the combined misfit value, $MV_c$, the stratigraphic vertical depth, $SVD_{sw}$ of the borehole of the subject well, wherein the stratigraphic vertical depth, $SVD_{sw}$ is determined to correspond to a minimum cost produced by the combined misfit value, $MV_c$; and drilling the borehole of the subject well responsive to the determined stratigraphic vertical depth, $SVD_{sw}$, to the target stratigraphic vertical depth of the subject well, $TSVD_{sw}$.

3. The method according to claim 2, wherein the plurality of measurements from the plurality of offset well logs are combined into one reference log, and the method further comprising:

taking a plurality of measurements at the plurality of measured depths, $MD_{sw}$ along the borehole of the subject well;

selecting a plurality of offset well logs with measurements at true vertical depths, $TVD_{ow}$;

generating a mapping of true vertical depths, $TVD_{ow}$ against stratigraphic vertical depth, $SVD_{ow}$, which relates a stratigraphic vertical depth, $SVD_{ow}$, to the corresponding true vertical depths, $TVD_{ow}$ of the plurality of the offset well logs;

combining the measurements of the plurality of the offset well logs into a common reference well log organized by stratigraphic vertical depths of the offset well logs, $SVD_{ow}$;

computing the Misfit value, MV for each of a plurality of pairs of measurements at subject well measured depths, $MD_{sw}$ and reference well log organized by stratigraphic vertical depths, $SVD_{ow}$;

determining, responsive to the computed misfit value, MV, the stratigraphic vertical depth of the subject well, $SVD_{sw}$, wherein the stratigraphic vertical depth, $SVD_{sw}$ is determined to correspond to a minimum cost produced by the Misfit value, MV; and using the determined stratigraphic vertical depth, $SVD_{sw}$, to steer the subject well to a desired stratigraphic depth range.

4. The method according to claim 1, wherein the measurements on the subject well log and offset well log include any one or more of gamma ray intensity, azimuthal gamma, resistivity, azimuthal resistivity, density, porosity, rate of progress, mechanical specific energy, rock compressive strength, rate of penetration, differential pressure, and weight on bit.

5. The method according to claim 1, wherein a stochastic model is used to compute a probability distribution of stratigraphic vertical depth, SVDsw at any point along the wellbore.

6. The method according to claim 1, wherein the misfit value MV is displayed as a heat map.

7. The method according to claim 6, wherein the misfit value, MV is displayed using a combination of measured depths, $MD_{SW}$ along the borehole of the subject well, stratigraphic vertical depth, SVDow of the offset well, Relative Stratigraphic Vertical Depth, RSVDow, true vertical depths, TVDow of the offset well, and Vertical Section on an X axis and a Y axis.

8. The method according to claim 6, wherein the heat map displays any one or more of ancillary data, such as a well plan, a surveyed wellbore position, geological markers, seismic velocities, and other geophysical data.

9. The method according to claim 6, wherein multiple heat maps for multiple measurement types or multiple offset well logs are displayed simultaneously.

10. The method according to claim 6, wherein an operator manually interprets paths of a minimal misfit in the heat map to specify the stratigraphic vertical depth, $SVD_{SW}$ of the subject wellbore.

11. The method according to claim 1, wherein a cost function minimization is guided by an operator by specifying stratigraphic control points.

12. The method according to claim 1, wherein the steps are automatically performed by a computer system.

13. The method according to claim 12, wherein the computer system sends one or more signals to one or more control systems of a drilling rig to modify one or more drilling operations or parameters to thereby drill to the stratigraphic target.

14. The method according to claim 1, further comprising modifying a drill plan responsive to the determined stratigraphic vertical depth, $SVD_{sw}$ of the subject well.

15. A computer system comprising:

a processor;

a memory coupled to the processor, the memory containing instructions executable by the processor for performing some or all of the following steps:

taking a plurality of measurements at a plurality of measured depths, MDsw along a borehole of a subject well being drilled;

selecting a plurality of offset well logs with measurements at a plurality of stratigraphic vertical depths, SVDow, each having a plurality of measurements at true vertical depths, TVDow;

computing a misfit value, MV for each of a plurality of pairs of measurements of the subject well at the measured depths, MDsw and the offset well stratigraphic vertical depths, SVDow, wherein the misfit value, MV is computed using the plurality of offset well logs;

generating a mapping of true vertical depths, TVDow against stratigraphic vertical depth, SVDow, wherein the mapping relates a stratigraphic vertical depth, SVDow to the corresponding true vertical depths, TVDow of the plurality of the offset well logs;

computing a combined Misfit value, MVc for each of the measurements at the subject well measured depths, MDsw and offset measurements of true vertical depths, TVDow;

determining, responsive to the computed misfit value, MV and the combined misfit value, MVc, a stratigraphic vertical depth of the borehole of the subject well, SVDsw, wherein the stratigraphic vertical depth, $SVD_{sw}$ is determined to correspond to a minimum cost related to the combined misfit value, MVc; and sending one or more control signals to one or more control systems of a drilling rig drilling the subject well to drill the borehole of the subject well responsive to the determined stratigraphic vertical depth, SVDsw to a target stratigraphic depth, TSVDsw.

16. The system according to claim 15, further compromising instructions for:

combining the plurality of measurements from the plurality of offset well logs into one reference log;

taking a plurality of measurements at measured depths, MDsw along the borehole of the subject well;

selecting a plurality of offset well logs with measurements at true vertical depths, TVDow;

generating a mapping of true vertical depths, TVDow against stratigraphic vertical depth, SVDow, which relates a stratigraphic vertical depth, SVDow, to the corresponding true vertical depths, TVDow of the plurality of the offset well logs;

combining the measurements of the offset well logs into a common reference well log organized by stratigraphic vertical depth, SVDow;

computing the Misfit value, MV for each of a plurality of pairs of measurements at subject well measured depths, MDsw and reference well log stratigraphic vertical depth, SVDow;

determining, responsive to the misfit value, MV, the stratigraphic vertical depth of the subject well, SVDsw, by minimizing a cost related to the Misfit value, MV;

using the determined stratigraphic vertical depth, SVDsw, to steer the subject well to a desired stratigraphic vertical depth range; and sending one or more control signals to the one or more control systems of the drilling rig to drill to the desired stratigraphic depth range.

17. The system according to claim 15, wherein the measurements on the subject well log and offset well log include any one or more of gamma ray intensity, azimuthal gamma, resistivity, azimuthal resistivity, density, porosity, rate of progress, mechanical specific energy, rock compressive strength, rate of penetration, differential pressure, and weight on bit.

18. The system according to claim 15, wherein a stochastic model is used to characterize the misfit value.

19. The system according to claim 15, wherein a stochastic model is used to compute a probability distribution of stratigraphic depth of the wellbore.

20. The system according to claim 19, wherein a cost is associated with each stratigraphic depth and a steering decision is taken to minimize a probability-weighted total cost of the wellbore.

21. The system according to claim 15, further comprising instructions to display the misfit value MV as a heat map, with the display being located either or both at a drilling site for the subject well or at a remote location from the drilling site.

22. The system according to claim 21, wherein the misfit value, MV is displayed using a combination of measured depths, MDsw along the borehole of the subject well, stratigraphic vertical depth, SVDow of the offset well, Relative Stratigraphic Vertical Depth, RSVD, true vertical depths, TVDow of the offset well, and Vertical Section on an X axis and a Y axis.

23. The system according to claim 22, wherein at least a portion of the heat map displays ancillary data, such as a well plan, a surveyed wellbore position, geological markers, seismic velocities, and/or other geophysical data.

24. The system according to claim 21, wherein a plurality of misfit heat maps for either or both of a plurality of measurement types or a plurality of offset well logs are displayed simultaneously in 3D.

* * * * *